US005783979A

United States Patent [19]

Andoh et al.

[11] Patent Number: 5,783,979

[45] Date of Patent: Jul. 21, 1998

[54] DIELECTRIC RESONATOR DEVICE HAVING A SINGLE WINDOW FOR COUPLING TWO PAIRS OF RESONATOR COLUMNS

[75] Inventors: Masamichi Andoh; Tomiya Sonoda, both of Nagaokakyo; Taiyo Nishiyama, Takatusuki, all of Japan

[73] Assignee: Murata Manufacturing Co., Ltd., Japan

[21] Appl. No.: 570,974

[22] Filed: Dec. 12, 1995

[30] Foreign Application Priority Data

Dec. 15, 1994 [JP] Japan ..... 6-311957

[51] Int. Cl.[6] ..... H01P 1/20; H01P 7/10

[52] U.S. Cl. ..... 333/202; 333/219.1

[58] Field of Search ..... 333/202, 202 DB, 333/202 DR, 208, 209, 219, 219.1, 235, 212

[56] References Cited

FOREIGN PATENT DOCUMENTS

| | | | |
|---|---|---|---|
| 0661770 | 7/1995 | European Pat. Off. . | |
| 5067905 | 3/1993 | Japan | 333/219.1 |
| 9520248 | 7/1995 | WIPO . | |

OTHER PUBLICATIONS

Ishikawa et al., "800 MHz High Power Duplexer Using TM Dual Mode Dielectric Resonators"; *IEEE MTT-S Digest, vol. III*; Jun. 1-5, 1992; Albuqueque,NM; pp.1617-1620.

Bonetti et al.; "Application of Dual TM Modes to Triple-and Quadruple-Mode Filters"; *IEEE Transactions on Microwave Theory and Techniques*, vol. MTT-35, No. 12, Dec. 1987; pp. 1143-1149.

Official Novelty Report on United Kingdom Patent Application No. GB 9525490.0; Feb. 20, 1996.

*Primary Examiner*—Robert Pascal
*Assistant Examiner*—Barbara Summons
*Attorney, Agent, or Firm*—Ostrolenk, Faber, Gerb & Soffen, LLP

[57] ABSTRACT

A dielectric resonator device with a higher Q and a lower cost and which makes it possible to effect spatial coupling between predetermined dielectric columns of adjacent dielectric resonators without using any special coupling loop. One disclosed dielectric resonator device includes a first magnetic-field-coupling window for effecting magnetic field coupling between a first pair and a second pair of dielectric columns and a second magnetic-field-coupling window for effecting magnetic field coupling between a third pair of dielectric columns. Due to this construction, it is possible to successively effect magnetic field coupling between predetermined dielectric columns of adjacent dielectric resonators solely by spatial magnetic coupling, without having to employ any partition or special coupling loop. Further, this construction facilitates the provision of characteristics-adjusting holes perpendicularly to the plane made by each composite dielectric column.

33 Claims, 23 Drawing Sheets

DIELECTRIC RESONATOR DEVICE HAVING A SINGLE WINDOW FOR COUPLING TWO PAIRS OF RESONATOR COLUMNS

BACKGROUND OF THE INVENTION

1. Field of the Invention

This invention relates to a dielectric resonator device which includes a plurality of TM (transverse magnetic) multiplex-mode dielectric resonators each of which has a composite dielectric column that is composed of two or three dielectric columns crossing each other in a space surrounded by a conductor.

2. Description of the Related Art

In a conventional multi-stage dielectric resonator filter or the like, which is formed by combining TM dual-mode dielectric resonators, there are arranged a plurality of TM dual-mode dielectric resonators each of which consists of two dielectric columns coupled together by electric field coupling, with magnetic field coupling being effected between dielectric columns of one of predetermined classes of dielectric columns of adjacent TM dual-mode dielectric resonators.

FIG. 23 shows the construction of a conventional dielectric resonator device of this type.

The example shown in FIG. 23 employs two TM dual-mode dielectric resonators. In the drawing, numerals 1*a* and 1*b* indicate TM dual-mode dielectric resonators, which are composed of composite dielectric columns 9*a* and 9*b*, respectively, each of which consists of two dielectric columns crossing each other and is formed into an integral unit with a cavity 15*a*, 15*b*, respectively. A conductor layer is formed on the outer periphery of each of the cavities 15*a* and 15*b*. The composite dielectric columns 9*a* and 9*b* are provided with frequency adjusting holes 13*a*, 14*a*, 13*b* and 14*b*. In correspondence with these frequency adjusting holes, the cavities 15*a* and 15*b* are provided with holes 41*a*, 42*a*, 41*b* and 42*b* for retaining frequency adjusting members in such a manner that the members can be inserted and extracted. The frequency adjusting members are inserted into these holes, and, by adjusting the amount they are inserted, frequency adjustment is effected for the resonators formed by the dielectric columns. Further, the cavities 15*a* and 15*b* are provided with holes 43*a* and 43*b* for retaining coupling adjusting members in such a manner that they can be inserted and extracted with respect to the interior of the cavities. The coupling adjusting members are inserted into these holes, and, by adjusting the amount they are inserted, coupling adjustment is effected between the resonators formed by the dielectric columns. As shown in the drawing, the two TM dual-mode dielectric resonators are coupled together such that one of the openings of one of the cavities 15*a* and 15*b* is opposed to one of the openings of the other cavity in such a way that the planes defined by the composite dielectric columns 9*a* and 9*b* are parallel to each other, with a partition 52 being arranged therebetween. In the partition 52, there is formed a magnetic field coupling window for effecting magnetic field coupling between predetermined dielectric columns of the two composite dielectric columns 9*a* and 9*b*.

As described above, in a conventional dielectric resonator device using a plurality of TM dual-mode dielectric resonators, the component TM dual-mode resonators are arranged such that the planes defined by the composite dielectric columns are parallel to each other, with the result that the following problems are entailed:

(1) Since the frequency adjusting members and the coupling adjusting members cannot be inserted from the openings of the walls of the cavities holding the composite dielectric columns, the holes 41*a*, 42*a*, 43*a* and 43*b* for inserting and extracting the frequency adjusting members or the coupling adjusting members are provided in side surfaces of the cavities. However, these holes in the walls of the cavities are, as indicated by the arrows in FIG. 23, situated in the path of the real current flowing through the conductive layers provided on the outer periphery of the cavities, so that the above holes obstruct the real current, resulting in a deterioration in the Qo (no-load Q) of the resonator.

(2) As shown in FIG. 23, it is necessary to provide a partition 52 between the resonators, resulting in a large number of parts and a deterioration in Q, which is due to the partition.

(3) In the two TM dual-mode dielectric resonators shown in FIG. 23, the cavities 15*a* and 15*b* and the composite dielectric columns 9*a* and 9*b* are formed into integral units. In this formation process, it is impossible to simultaneously form the frequency adjusting holes 13*a*, 14*a*, 13*b* and 14*b* and the holes 41*a*, 42*a*, 41*b* and 42*b* for inserting and extracting frequency adjusting members. All of these holes have to be formed after the formation into integral units of the cavities and the composite dielectric columns, with the result that the resonator entails high costs.

(4) The window for effecting magnetic field coupling, which is provided between adjacent TM multiplex mode dielectric resonators, is only intended for coupling between two predetermined dielectric columns of these adjacent TM multiplex mode dielectric resonators. Thus, in a device using, for example, a triple-mode dielectric resonator, a coupling loop must be provided before coupling can be effected between predetermined dielectric columns.

In Japanese Patent Applications No. 6-201937, No. 6-223242, etc., the present applicant has already proposed dielectric resonator devices in which the above problems have been eliminated.

SUMMARY OF THE INVENTION

It is an object of this invention to provide a dielectric resonator device which not only solves the above problems but which eliminates the need for the coupling loop disclosed in Japanese Patent Application No. 6-201937 for effecting coupling between predetermined dielectric columns of adjacent dielectric resonators.

Another object of this invention is to provide a dielectric resonator device in which it is possible to achieve an enhancement in the degree of freedom in terms of the manner of coupling between adjacent ones of the dielectric columns of an array of multiplex mode dielectric resonators.

Still another object of this invention is to provide a dielectric resonator device with a small size and a large number of stages by using TM triple-mode dielectric resonators, without using any special coupling loop.

In a dielectric resonator device according to a first aspect of this invention, in order to independently effect magnetic field coupling between two pairs of dielectric columns of adjacent multiplex-mode dielectric resonators, there is provided a magnetic-field-coupling window, which comprises a section where the above-mentioned conductor is not provided and which allows, in the composite dielectric columns of two adjacent dielectric resonators, transmission of both the magnetic field of a first pair of dielectric columns extending in a first direction whose axes are substantially the same and the magnetic field of a second pair of dielectric columns extending in a second direction whose axes are substantially parallel to each other.

Further, in a dielectric resonator according to a second aspect of this invention, in addition to the realization of magnetic field coupling independently between two pairs of dielectric columns of two adjacent TM multiplex-mode dielectric resonators, coupling between the two dielectric columns of one of these TM multiplex-mode dielectric resonator is achieved by means of a structure for electric field coupling, which is provided in the crossing section of the dielectric columns in the first and second directions of the composite dielectric column of one of the two adjacent dielectric resonators to thereby effect electric field coupling between these dielectric columns.

Further, in a dielectric resonator device according to a third aspect of this invention, in order for different ones of TM multiplex-mode dielectric resonators arranged in a row to constitute input and output stages, there is provided a magnetic-field-coupling window which comprises a section where no conductor layer is formed and which allows, in the composite dielectric column of the dielectric resonator positioned at one end of the row and the composite dielectric column of the dielectric resonator adjacent thereto, transmission of both the magnetic field of the dielectric columns in the first direction whose axes are substantially the same and the magnetic field of the dielectric columns in the second direction whose axes are substantially parallel to each other; a structure for electric field coupling is provided in the crossing section of the dielectric columns in the first and second directions of the composite dielectric column of the above-mentioned dielectric resonator positioned at one end of the row to effect electric field coupling between these dielectric columns; there is provided a magnetic field coupling window which comprises a section where no conductor layer is formed and which allows, in the composite dielectric column of the dielectric resonator positioned at the other end of the row and the composite dielectric column of the dielectric resonator adjacent thereto, transmission of only the magnetic field of the dielectric columns in the first direction whose axes are substantially the same; and there is provided a structure for electric field coupling in the crossing section of the dielectric column in the first direction and a dielectric column crossing this dielectric column, constituting the composite dielectric column of the dielectric resonator positioned at the other end of the row, to effect electric field coupling between these dielectric columns.

Further, in a dielectric resonator device according to a fourth aspect of this invention, in order to construct the device by using a TM triple-mode dielectric resonator, without providing any special coupling loop, at least one of two adjacent dielectric resonators is formed as a TM triple-mode dielectric resonator; in the interface between these two adjacent dielectric resonators, there is provided a magnetic-field-coupling window, which comprises a section where no conductor layer is formed and which allows, in the composite dielectric columns of these two adjacent dielectric resonators, transmission of both the magnetic field of the dielectric columns in the first direction whose axes are substantially the same and the magnetic field of the dielectric columns in the second direction whose axes are substantially parallel to each other; and, in the composite dielectric column of the above-mentioned TM triple-mode dielectric resonator, there is provided, in the crossing section of the dielectric column in the first direction and a dielectric column in a third direction, which crosses the first and second directions, an electric-field-coupling structure for effecting electric field coupling between these dielectric columns.

Other features and advantages of the present invention will become apparent from the following description of the invention which refers to the accompanying drawings.

DETAILED DESCRIPTION OF EMBODIMENTS OF THE INVENTION

Figure 1:
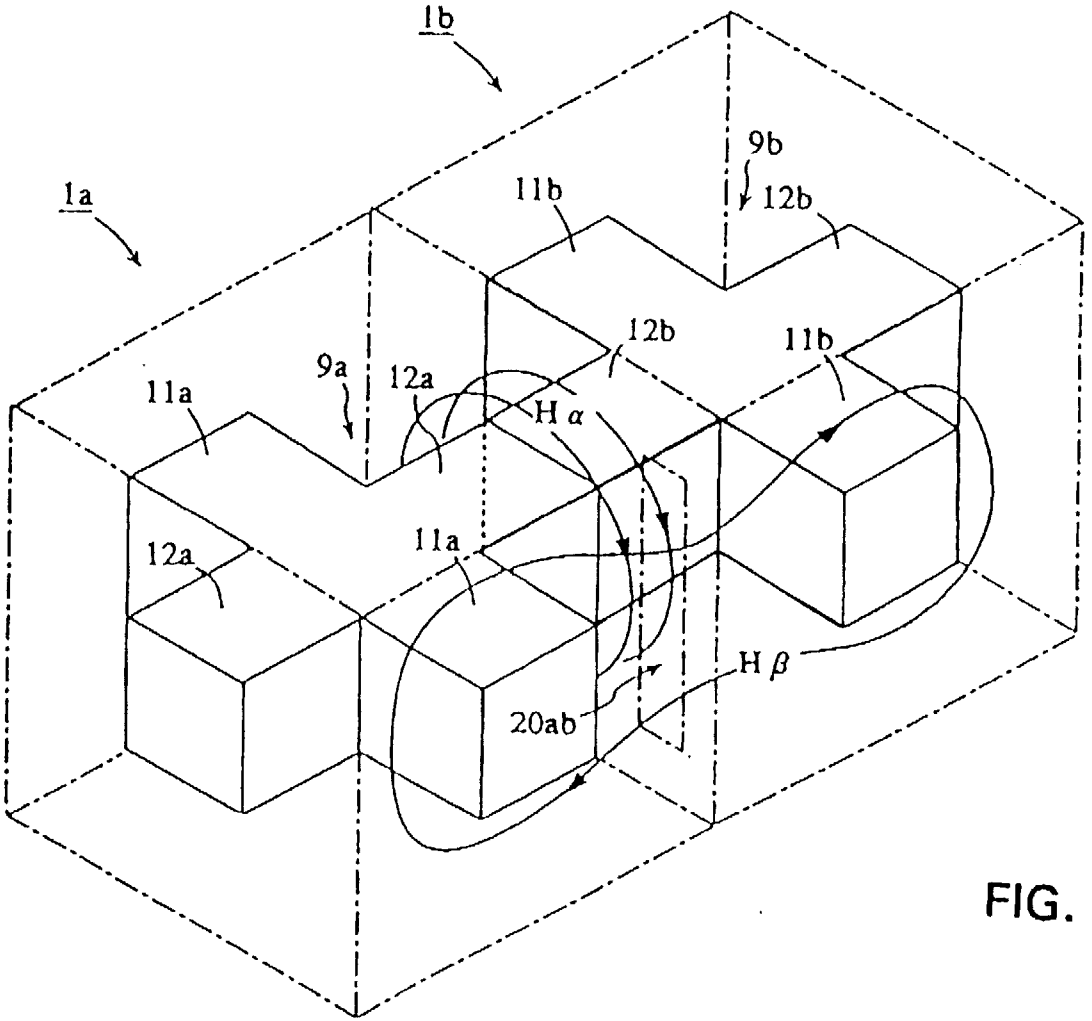
FIG. 1 is a conceptual diagram showing an example of the construction of a dielectric resonator device according to a first aspect of the invention.

FIG. 1 is a conceptual diagram showing an example of the construction of a dielectric resonator device according to the above-described first aspect of the invention. In FIG. 1, numerals 1*a* and 1*b* indicate TM dual-mode dielectric resonators. Numeral 9*a* indicates a composite dielectric column that is formed of dielectric columns 11*a* and 12*a* crossing each other; and numeral 9*b* indicates a composite dielectric column that is formed of dielectric columns 11*b* and 12*b* crossing each other. Each of these two composite dielectric columns 9*a* and 9*b* is surrounded by a conductor indicated by a dashed line, and, further, a magnetic-field-coupling window 20*ab* is provided, which comprises a section where no conductor is provided and which allows, in the composite dielectric columns 9*a* and 9*b*, transmission of both the magnetic field Hα of dielectric columns 12*a* and 12*b* in a first direction whose axes are substantially the same and the magnetic field Hβ of dielectric columns 11*a* and 11*b* in a second direction whose axes are substantially parallel to each other.

When the two composite dielectric columns 9*a* and 9*b* and the magnetic-field-coupling window 20*ab* are arranged as shown in FIG. 1 to form a dielectric resonator device according to the first aspect of the invention, the dielectric columns 12*a* and 12*b* are coupled with each other by magnetic field coupling through the magnetic-field-coupling window 20*ab* as indicated by the magnetic field Hα, and, at the same time, the dielectric columns 11*a* and 11*b* are coupled with each other by magnetic field coupling through the magnetic-field-coupling window 20*ab* as indicated by the magnetic field Hβ. Since these magnetic fields are orthogonal to each other, the two magnetic field couplings are independent of each other. Thus, the device of the example shown in FIG. 1 functions as two pairs of two-stage dielectric resonators, one of which is composed of the dielectric columns 12*a* and 12*b* and the other composed of the dielectric columns 11*a* and 11*b*.

Figure 2:
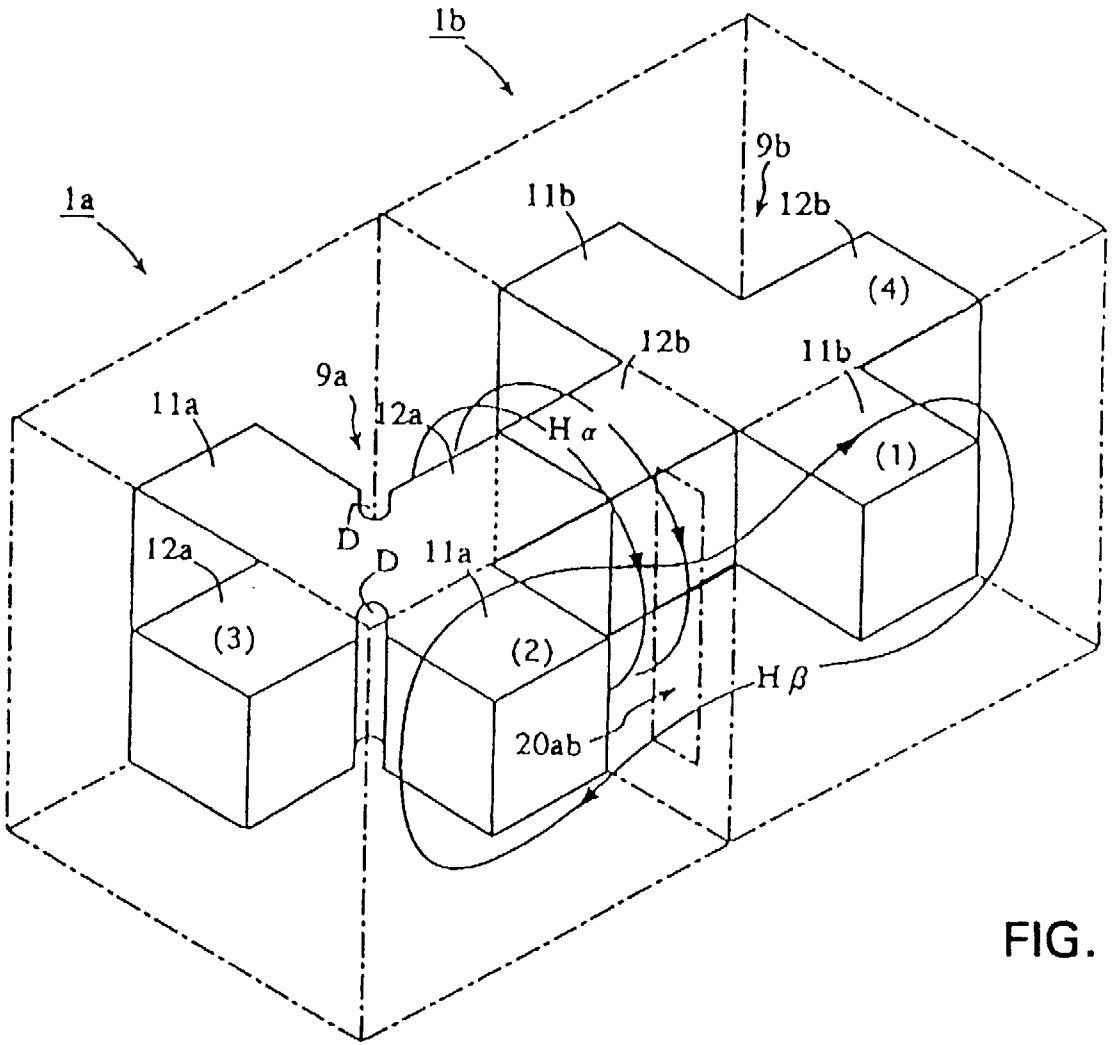
FIG. 2 is a conceptual diagram showing an example of the construction of a dielectric resonator device according to a second aspect of the invention.
Figure 3:
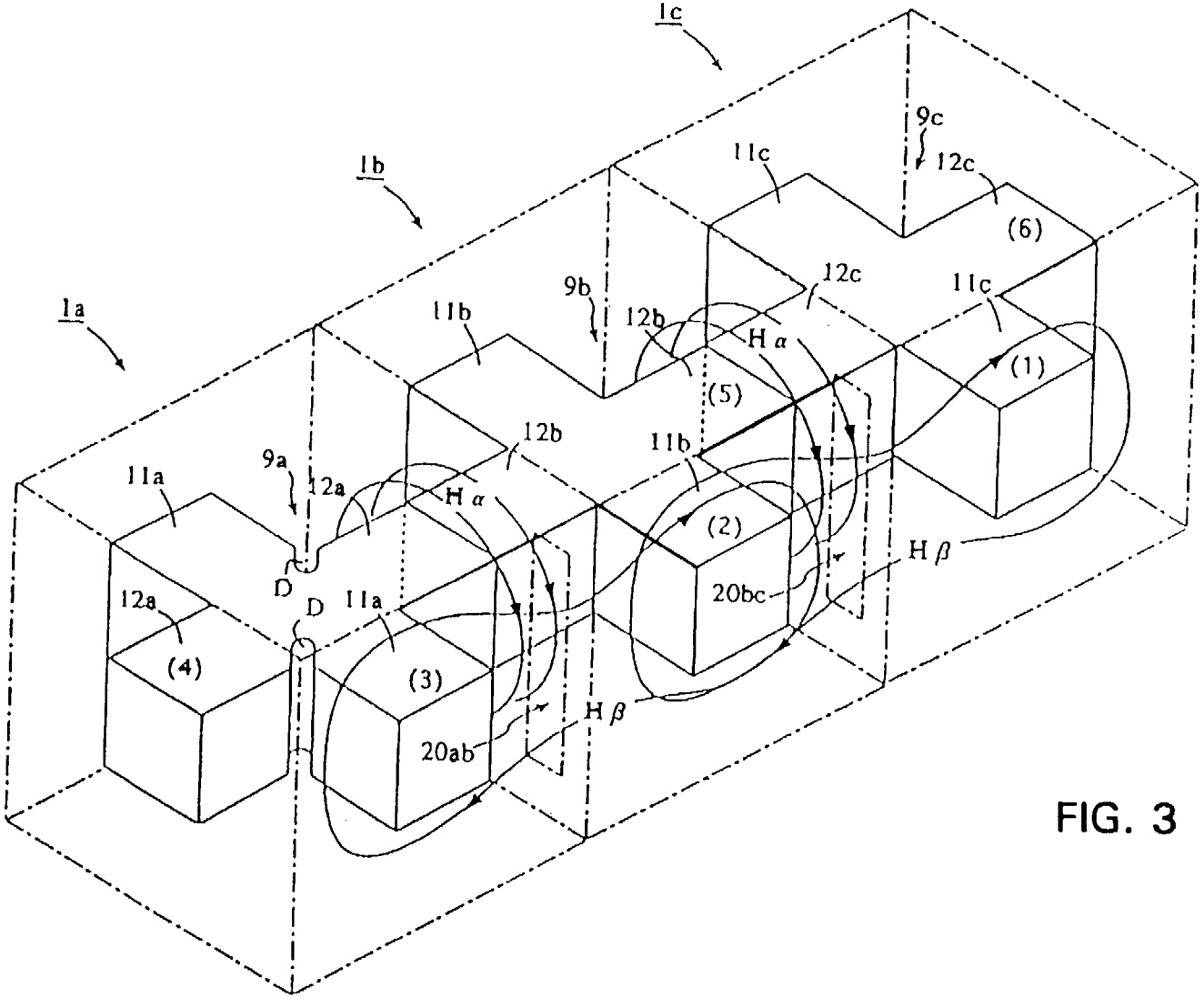
FIG. 3 is a conceptual diagram showing another example of the construction of a dielectric resonator device according to the second aspect.
Figure 4:
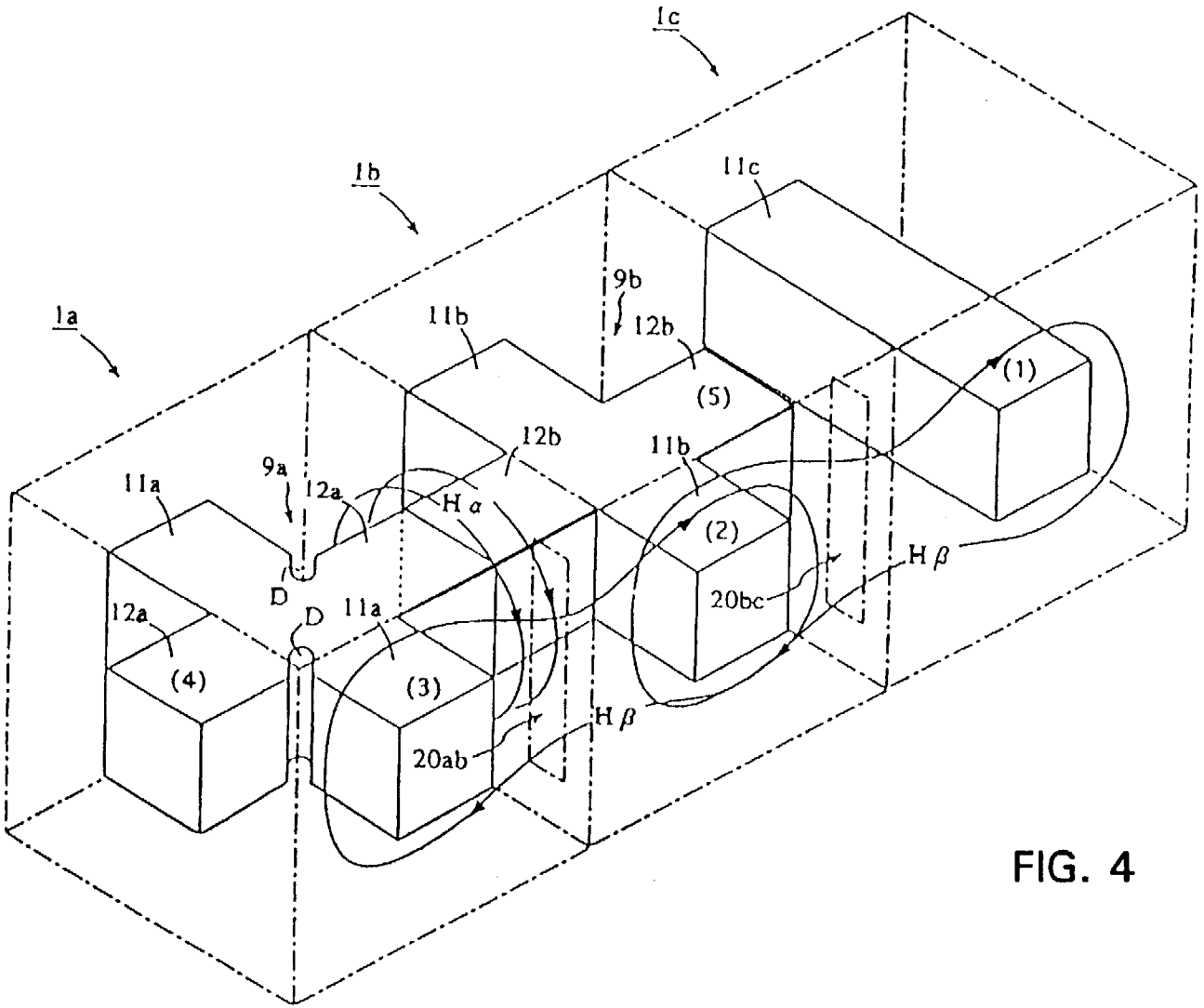
FIG. 4 is a conceptual diagram showing still another example of the construction of a dielectric resonator device according to the second aspect.
Figure 5:
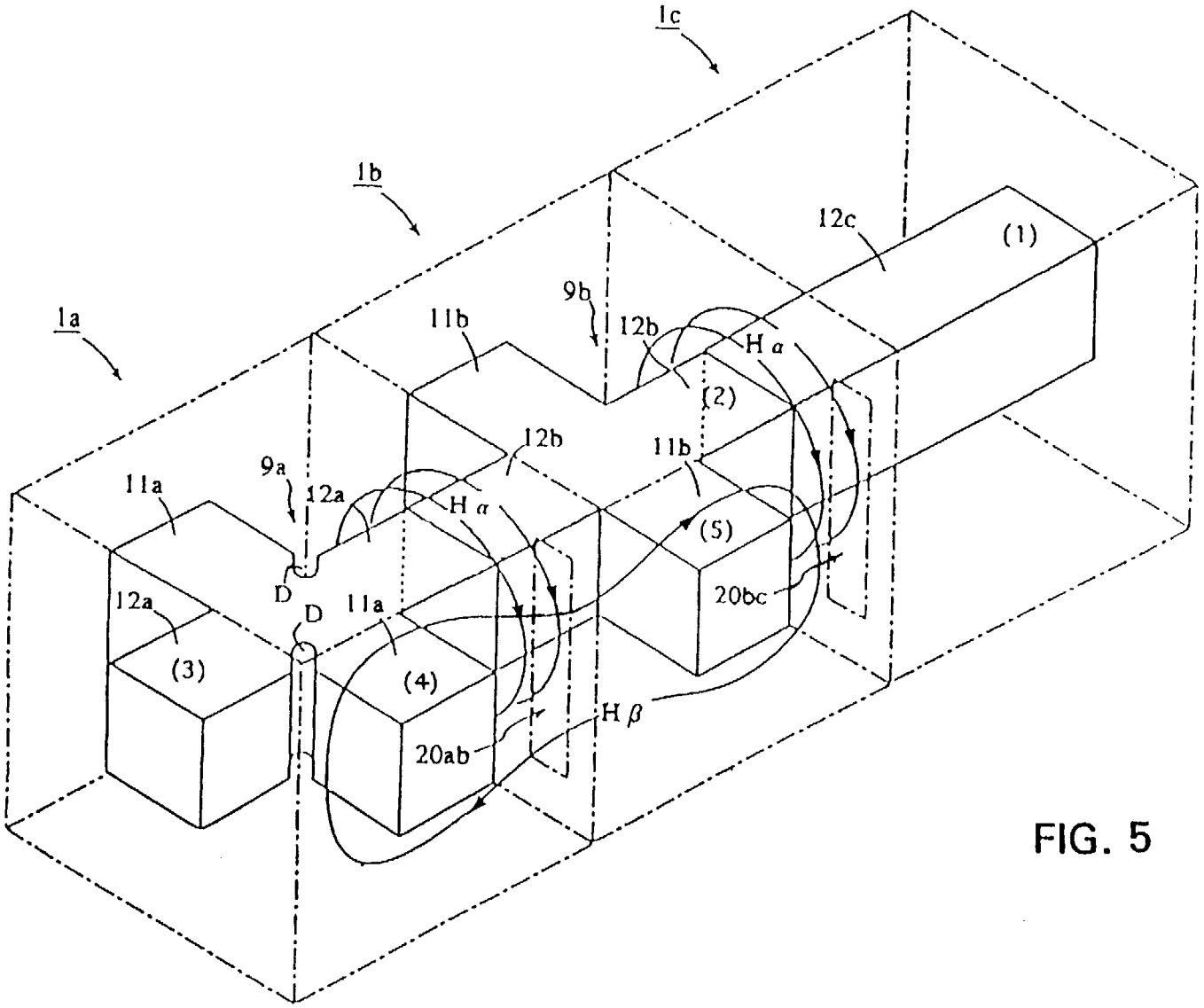
FIG. 5 is a conceptual diagram showing a further example of the construction of a dielectric resonator device according to the second aspect.

FIGS. 2 through 5 are conceptual diagrams showing four examples of the construction of the above-described dielectric resonator device, according to the second aspect of the invention. As shown in FIGS. 2 through 5, grooves for electric field coupling D are provided in the crossing section of the dielectric column 12*a* in the first direction and the dielectric column 11*a* in the second direction of the composite dielectric column of one of two adjacent dielectric resonators 1*a* and 1*b* in order to effect electric field coupling between these dielectric columns. FIGS. 3, 4 and 5 show examples in which a third dielectric resonator 1*c* is added to the dielectric resonator device shown in FIG. 2. In the example shown in FIG. 3, there is provided a magnetic-field-coupling window 20*bc* which comprises a section where no conductor layer is formed and which allows, in the composite dielectric columns 9*b* and 9*c*, transmission of both the magnetic field Hα of the dielectric columns 12*b* and 12*c* in the first direction whose axes are substantially the same and the magnetic field Hβ of the dielectric columns 11*b* and 11*c* in the second direction whose axes are substantially parallel to each other. In the example shown in FIG. 4, there is provided a magnetic-field-coupling window 20*bc* which comprises a section where no conductor layer is formed and which allows transmission of the magnetic field Hβ of the dielectric columns 11*b* and 11*c* in the second direction whose axes are substantially parallel to each other. In the example shown in FIG. 5, there is provided a magnetic-field-coupling window 20*bc* which comprises a section where no conductor layer is formed and which allows transmission of the magnetic field Hα of the dielectric columns 12*b* and 12*c* in the first direction whose axes are substantially the same.

A dielectric resonator device according to the second aspect of this invention is formed, as shown, for example, in FIG. 2, such that the dielectric columns 12*a* and 12*b* are coupled with each other by magnetic field coupling through the magnetic-field-coupling window 20*ab* as indicated by the magnetic field Hα, and, at the same time, the dielectric columns 11*a* and 11*b* are coupled with each other by magnetic field coupling through the magnetic-field-coupling window 20*ab* as indicated by the magnetic field Hβ; further, electric-field-coupling grooves D are provided in the crossing section of the two dielectric columns 11*a* and 12*a*, which constitute the composite dielectric column 9*a*, so that these dielectric columns 11*a* and 12*a* are coupled with each other by electric field coupling. Thus, coupling is effected in the order as indicated by numerals (1)-(2)-(3)-(4) in the drawing, which means the device functions as a dielectric resonator device consisting of a four-stage resonator.

In the example shown in FIG. 3, magnetic field coupling is effected between the dielectric columns 12*b* and 12*c* through the magnetic-field-coupling window 20*bc* as indicated by the magnetic field Hα, and magnetic field coupling is effected between the dielectric columns 11*b* and 11*c* through the magnetic-field-coupling window 20*bc* as indicated by the magnetic field Hβ. Thus, coupling is effected in the order as indicated by numerals (1)-(2)-(3)-(4)-(5)-(6) in the drawing, which means the device functions as a dielectric resonator device consisting of a six-stage resonator.

In the example shown in FIG. 4, magnetic field coupling is effected between the dielectric columns 11*b* and 11*c* through the magnetic-field-coupling window 20*bc* as indicated by the magnetic field Hβ. In the example shown in FIG. 5, magnetic field coupling is effected between the dielectric columns 12b and 12c through the magnetic-field-coupling window 20bc as indicated by the magnetic field Hα. Thus, in either case, coupling is effected in the order as indicated by numerals (1)-(2)-(3)-(4)-(5), which means the device functions as a dielectric resonator devices consisting of a five-stage resonator.

Figure 6:
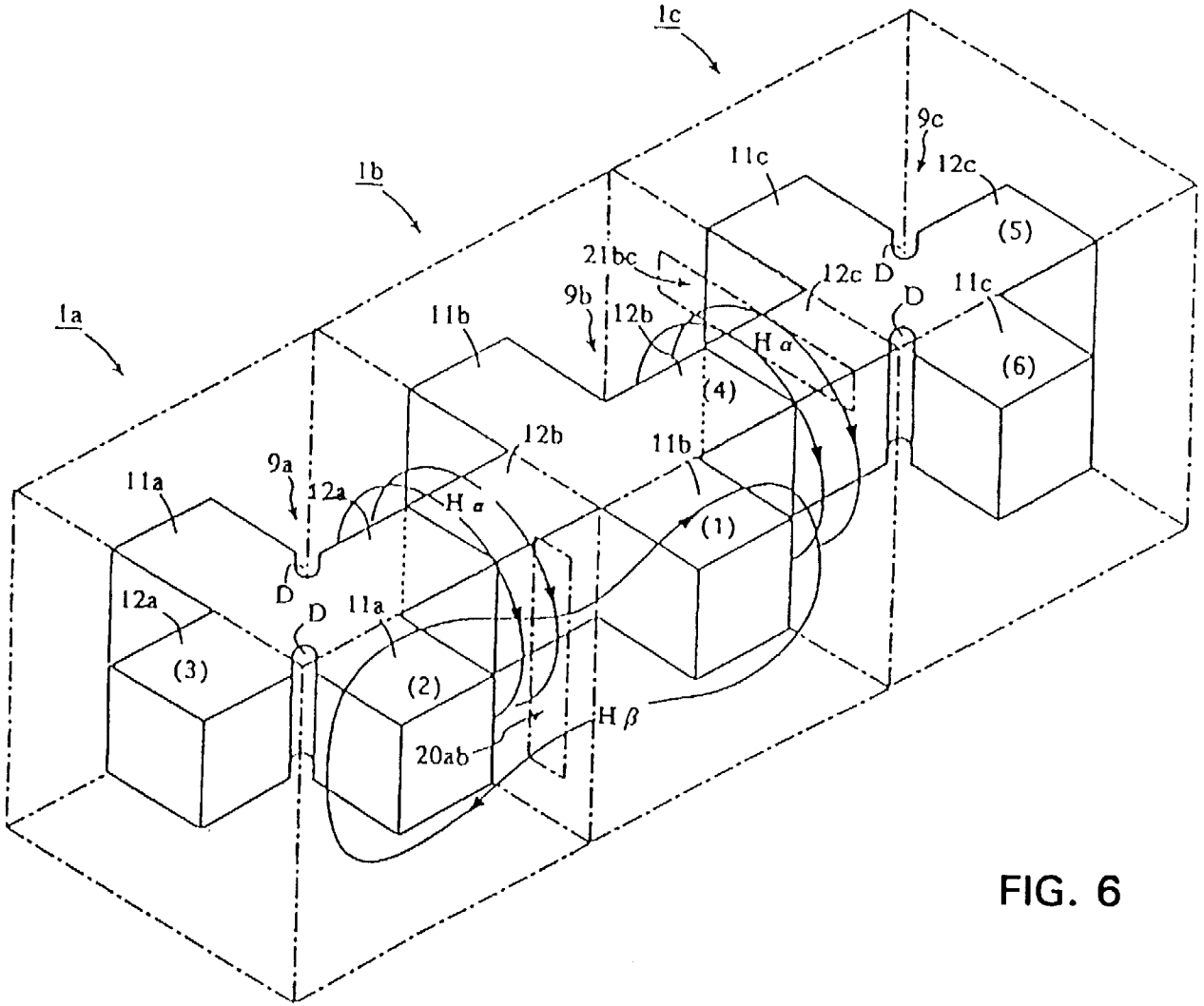
FIG. 6 is a conceptual diagram showing an example of the construction of a dielectric resonator device according to a third aspect of the invention.
Figure 7:
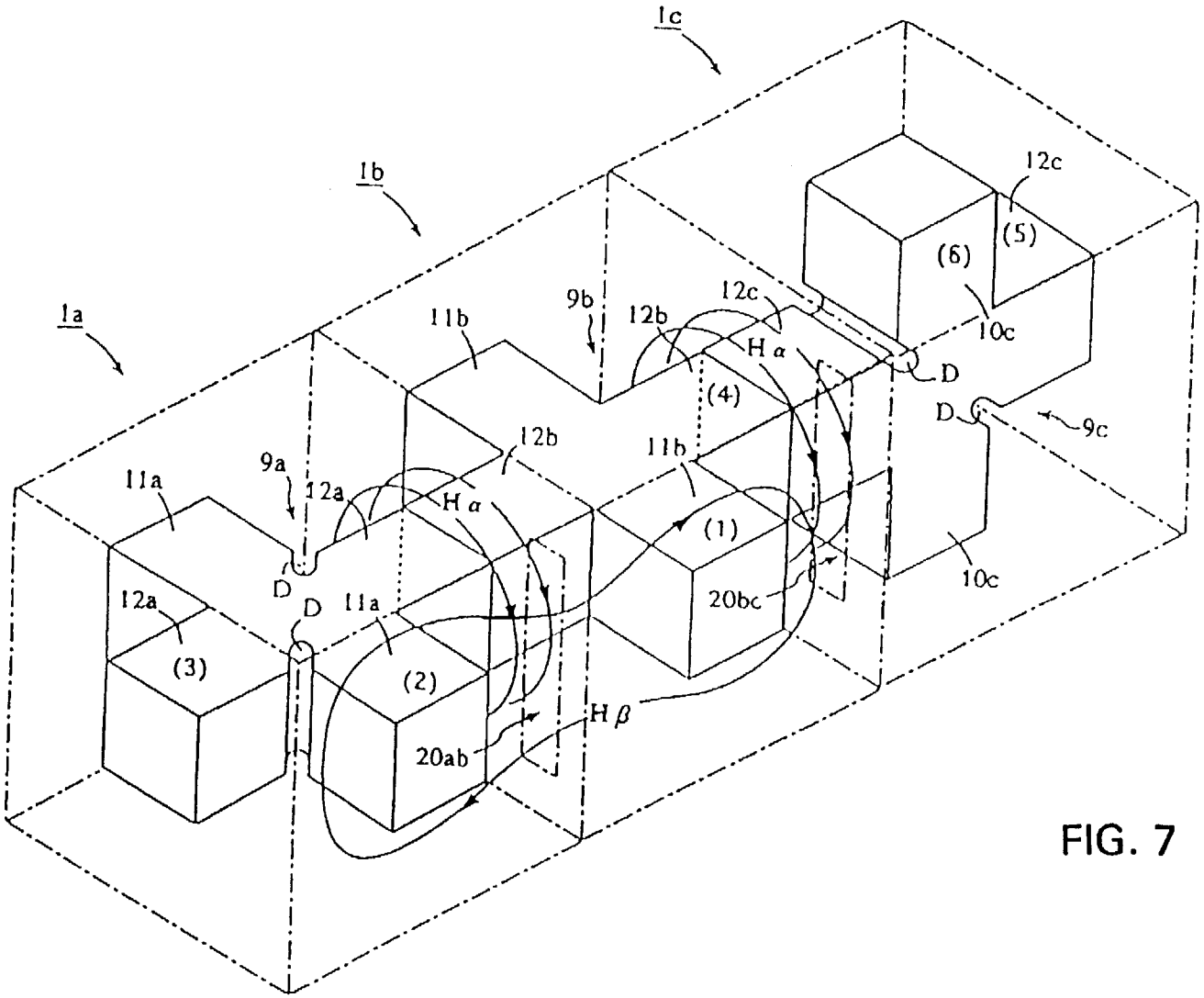
FIG. 7 is a conceptual diagram showing another example of the construction of a dielectric resonator device according to the third aspect.

FIGS. 6 and 7 are conceptual diagrams showing two examples of the construction of the above-described dielectric resonator device, according to the third aspect of the invention. As shown in the drawings, in the interface between the dielectric resonator 1a positioned at one end of a row of resonators and the dielectric resonator 1b that is adjacent thereto, there is provided a magnetic-field-coupling window 20ab, which comprises a section where no conductor layer is formed and which allows, in the composite dielectric columns 9a and 9b of these dielectric resonators 1a and 1b, transmission of both the magnetic field of the dielectric columns 12a and 12b in the first direction whose axes are substantially the same and the magnetic field of the dielectric columns 11a and 11b in the second direction whose axes are substantially parallel to each other. In the above-mentioned dielectric resonator 1a, which is positioned at one end of the row of resonators, electric-field-coupling grooves D are provided in the crossing section of the dielectric column 12a in the first direction and the dielectric column 11a in the second direction, the two constituting the composite dielectric column 9a of this dielectric resonator 1a, to effect electric field coupling between these dielectric columns. In the interface between the dielectric resonator 1c which is positioned at the other end of the row and the dielectric resonator 1b that is adjacent thereto, there is provided a magnetic-field-coupling window 21bc, which comprises a section where no conductor layer is formed and which allows transmission of only the magnetic field of the dielectric columns 12c and 12b in the first direction, whose axes are substantially the same, of the composite dielectric column 9c. And, in the dielectric resonator 1c which is positioned at the other end of the row, electric-field-coupling grooves D are provided in the crossing section the dielectric column 12c in the first direction and a dielectric column crossing this dielectric column (which is indicated by numeral 11c in FIG. 6 and by numeral 10c in FIG. 7), the two constituting the composite dielectric column 9c of this dielectric resonator 1c, to effect electric field coupling between these dielectric columns.

A dielectric resonator device according to the third aspect of this invention is formed, as shown, for example, in FIG. 6, such that the dielectric columns 12b and 12c are coupled with each other by magnetic field coupling through the magnetic-field-coupling window 21bc as indicated by the magnetic field Hα. As for the dielectric columns 11b and 11c, which are parallel to each other, scarcely any magnetic field coupling is effected between them since the width of the magnetic-field-coupling window 21bc is small with respect to the direction of the magnetic field generated by the dielectric columns 11b and 11c. Further, due to the electric-field-coupling grooves D provided in the crossing section of the two dielectric columns 11c and 12c of the composite dielectric column 9c, coupling is effected in the order as indicated by numerals (1)-(2)-(3)-(4)-(5)-(6), which means the device functions as a dielectric resonator device consisting of a six-stage resonator.

In the example shown in FIG. 7, the dielectric columns 12b and 12c are coupled with each other by magnetic field coupling through the magnetic-field-coupling window 20bc as indicated by the magnetic field Hα. As for the dielectric columns 11b and 10c, which are orthogonal to each other, no magnetic field coupling is effected between them. Further, due to the electric-field-coupling grooves D that are provided in the crossing section of the two dielectric columns 10c and 12c of the composite dielectric column 9c, coupling is effected in the order as indicated by numerals (1)-(2)-(3)-(4)-(5)-(6), as in the above case, which means the device functions as a dielectric resonator device consisting of a six-stage resonator.

Figure 8:
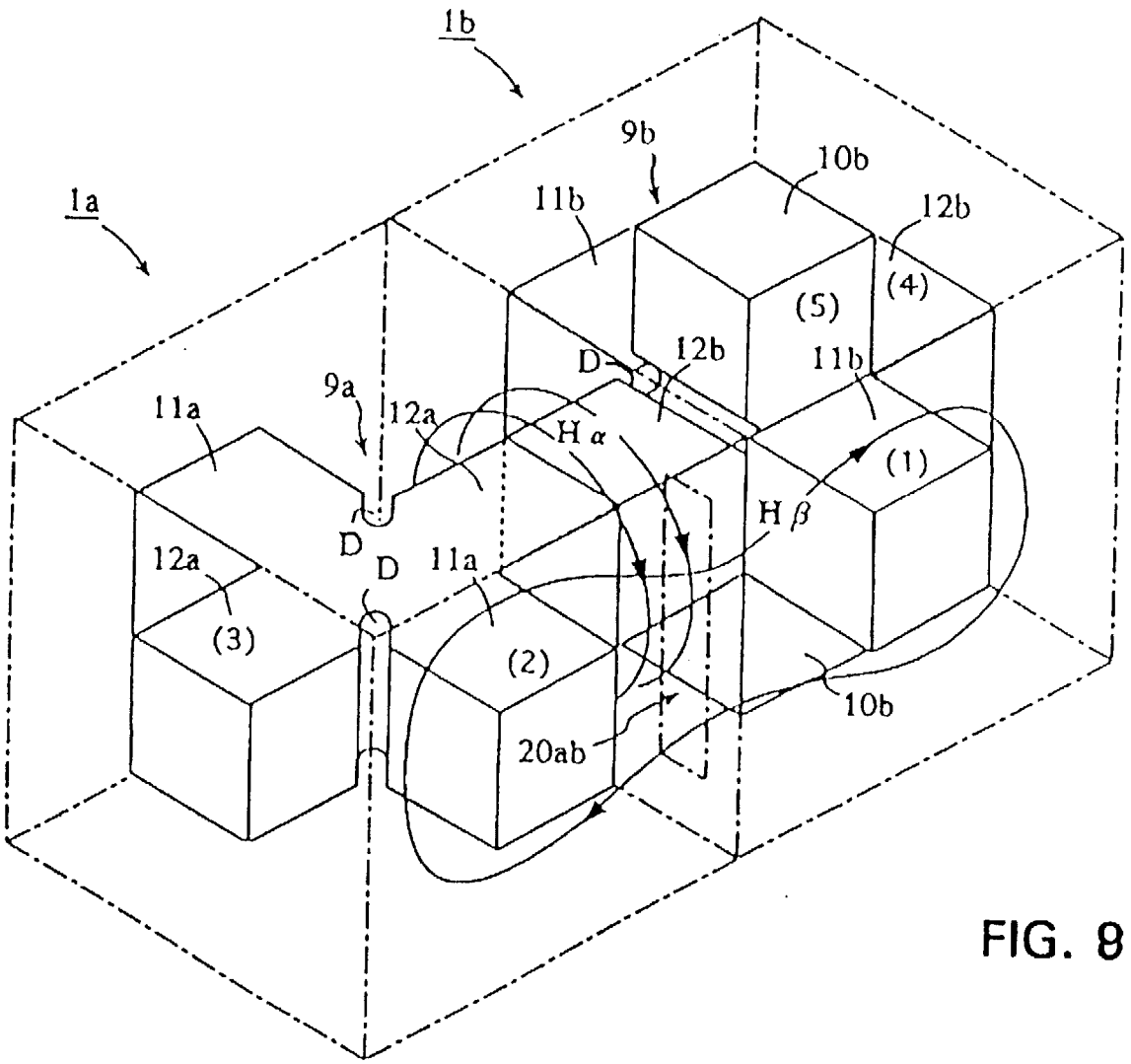
FIG. 8 is a conceptual diagram showing an example of the construction of a dielectric resonator device according to a fourth aspect of the invention.
Figure 9:
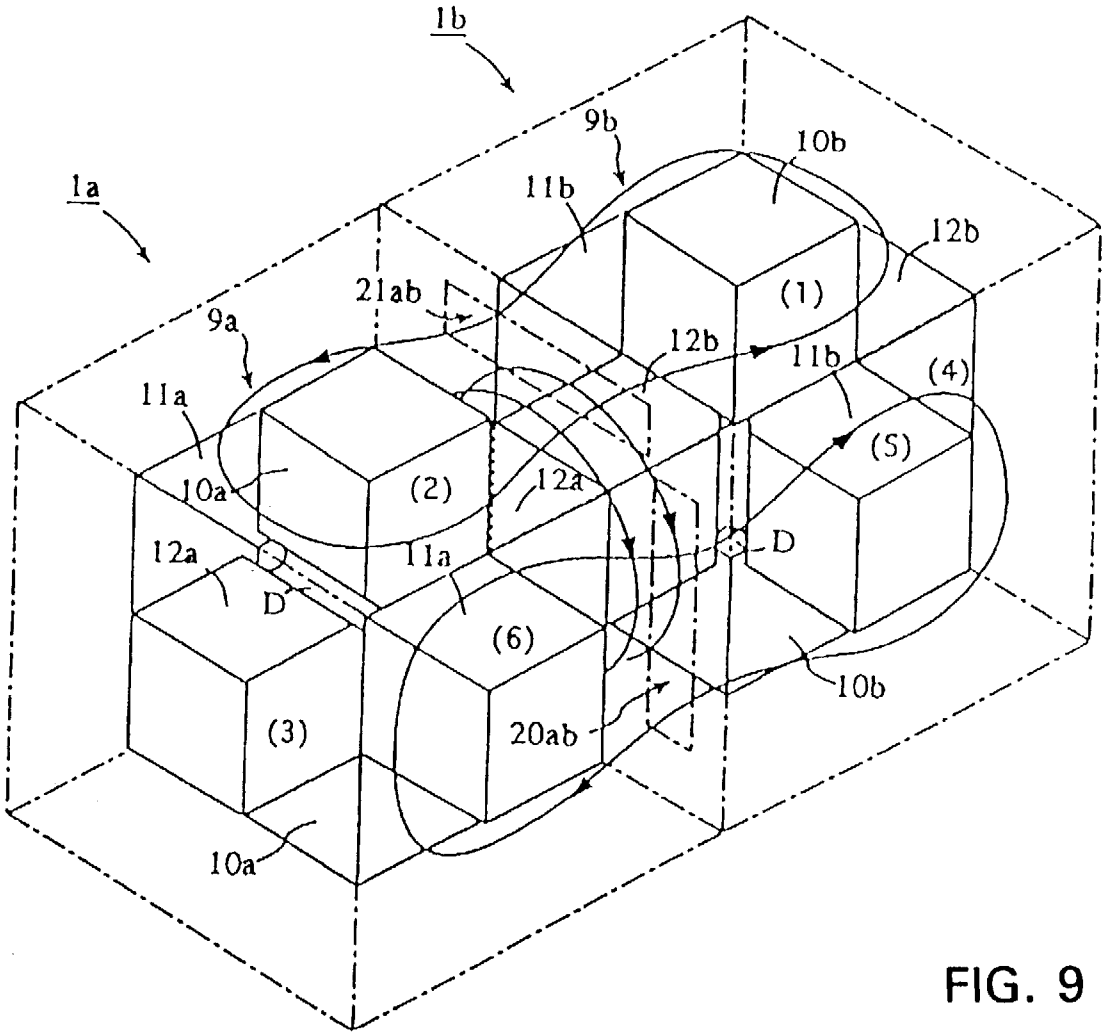
FIG. 9 is a conceptual diagram showing another example of the construction of a dielectric resonator device according to the fourth aspect.
Figure 10:
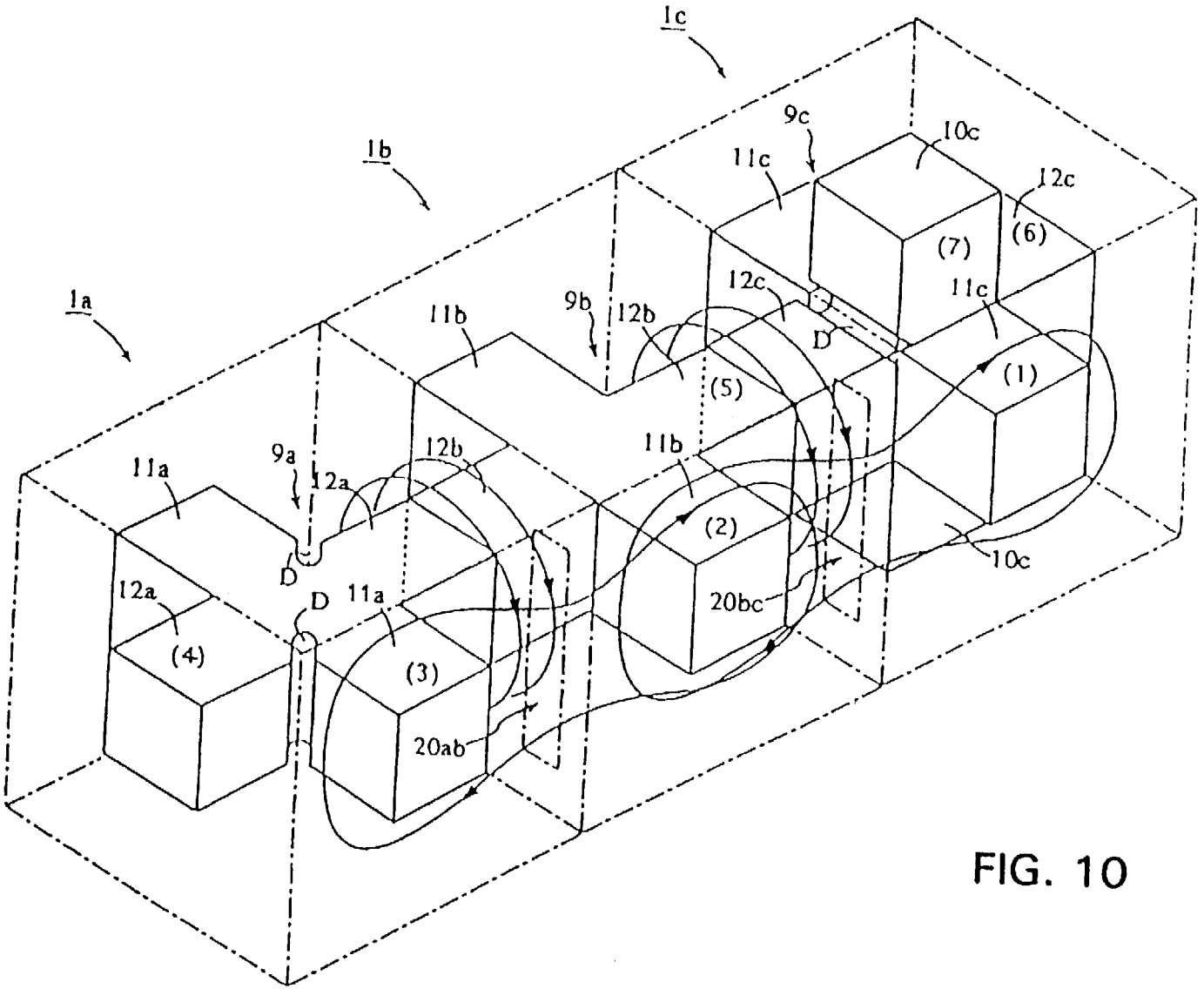
FIG. 10 is a conceptual diagram showing still another example of the construction of a dielectric resonator device according to the fourth aspect.

FIGS. 8 through 10 are conceptual diagrams showing three examples of the construction of the above-described dielectric resonator device, according to the fourth aspect of the invention. As shown in FIG. 8, of two adjacent dielectric resonators 1a and 1b, at least one of them (the dielectric resonator 1b in this case) is formed as a TM triple-mode dielectric resonator; in the interface between these two adjacent dielectric resonators, there is provided a magnetic-field-coupling window 20ab, which comprises a section where no conductor layer is formed and which allows, in the composite dielectric columns 9a and 9b of these adjacent dielectric resonators, transmission of both the magnetic field of the dielectric columns 12a and 12b in the first direction, whose axes are substantially the same, and the magnetic field of the dielectric columns 11a and 11b in the second direction, whose axes are substantially parallel to each other; and, in the composite dielectric column 9b of the TM triple-mode dielectric resonator, an electric-field-coupling groove D is provided in the crossing section of the dielectric column 12b in the first direction and a dielectric column 10b in a third direction, which crosses the first and second directions, to effect electric field coupling between these dielectric columns. Further, as shown in FIG. 9, of two adjacent dielectric resonators 1a and 1b, at least one of them (which is the dielectric resonator 1a in this case) is formed as a TM triple-mode dielectric resonator; in the interface between these two adjacent dielectric resonators, there is provided a magnetic-field-coupling window 20ab, which comprises a section where no conductor layer is formed and which allows, in the composite dielectric columns 9a and 9b of these adjacent dielectric resonators, transmission of both the magnetic field of the dielectric columns 12a and 12b in the first direction, whose axes are substantially the same, and the magnetic field of the dielectric columns 11a and 11b in the second direction, whose axes are substantially parallel to each other; and, in the composite dielectric column 9a of the TM triple-mode dielectric resonator, an electric-field-coupling groove D is provided in the crossing section of the dielectric column 12a in the first direction and a dielectric column 10a in a third direction, which crosses the first and second directions, to effect electric field coupling between these dielectric columns. In the example shown in FIG. 9, the remaining dielectric resonator 1b is also formed as a TM triple-mode dielectric resonator; in the interface between these two adjacent dielectric resonators, there is provided a magnetic-field-coupling window 21ab, which comprises a section where no conductor layer is formed and which allows, in the composite dielectric columns 9a and 9b of these adjacent dielectric resonators, transmission of both the magnetic field of the dielectric columns 12a and 12b in the first direction, whose axes are substantially the same, and the magnetic field of the dielectric columns 10a and 10b in the second direction, whose axes are substantially parallel to each other; and, in the composite dielectric column 9b of the TM triple-mode dielectric resonator, an electric-field-coupling groove D is provided in the crossing section of the dielectric column 12b in the first direction and the dielectric column 10b in the third direction, which crosses the first and second directions, to effect electric field coupling between these dielectric columns. Further, as shown in FIG. 10, of two adjacent dielectric resonators 1*b* and 1*c*, at least one of them (which is the dielectric resonator 1*c* in this case) is formed as a TM triple-mode dielectric resonator; in the interface between these two adjacent dielectric resonators, there is provided a magnetic-field-coupling window 20*bc*, which comprises a section where no conductor layer is formed and which allows, in the composite dielectric columns 9*b* and 9*c* of these two adjacent dielectric resonators, transmission of both the magnetic field of the dielectric columns 12*b* and 12*c* in the first direction, whose axes are substantially the same, and the magnetic field of the dielectric columns 11*b* and 11*c* in the second direction, whose axes are substantially parallel to each other; and, in the composite dielectric column 9*c* of the TM triple-mode dielectric resonator, an electric-field-coupling groove D is provided in the crossing section of the dielectric column 12*c* in the first direction and a dielectric column 10*c* in a third direction, which crosses the first and second directions, to effect electric field coupling between these dielectric columns. In the example shown in FIG. 10, another dielectric resonator 1*a* is provided; the relationship between the dielectric resonators 1*a* and 1*b* is the same as that shown in FIG. 2.

A dielectric resonator device according to the fourth aspect of this invention is formed, in the case of the construction shown in FIG. 8, such that the dielectric columns 11*a* and 11*b* are coupled with each other by magnetic field coupling through the magnetic-field-coupling window 20*ab* as indicated by the magnetic field Hβ. Further, the dielectric columns 12*a* and 12*b* are also coupled with each other by magnetic field coupling through the magnetic-field-coupling window 20*ab* as indicated by the magnetic field Hα. Further, due to the electric-field-coupling grooves D that are provided in the crossing section of the two dielectric columns 11*a* and 12*a* of the composite dielectric column 9*a*, electric field coupling is effected between these dielectric columns 11*a* and 12*a*. Further, due to the electric-field-coupling groove D provided in the crossing section of the two dielectric columns 10*b* and 12*b* of the composite dielectric column 9*b*, electric field coupling is effected between these dielectric columns 10*b* and 12*b*. Between the dielectric columns 11*a* and 10*b*, and between the dielectric columns 12*a* and 10*b*, no coupling is effected due to their orthogonal relationship. Thus, coupling is effected in the order as indicated by numerals (1)-(2)-(3)-(4)-(5), which means the device functions as a dielectric resonator device consisting of a five-stage resonator.

In the example shown in FIG. 9, the dielectric columns 11*a* and 11*b* are coupled with each other by magnetic field coupling through the magnetic-field-coupling window 20*ab*, and the dielectric columns 10*a* and 10*b* are coupled with each other by magnetic field coupling through the magnetic-field-coupling window 21*ab*. As for the dielectric columns 12*a* and 12*b*, magnetic field coupling is effected between them through both the magnetic-field-coupling windows 20*ab* and 21*ab*. Further, due to the electric-field-coupling groove D provided in the crossing section of the dielectric columns 10*a* and 12*a*, electric field coupling is effected between these dielectric columns 10*a* and 12*a*, and, due to the electric-field-coupling groove D provided at the crossing section of the dielectric columns 11*b* and 12*b*, electric field coupling is effected between these dielectric columns 11*b* and 12*b*. Thus, coupling is effected in the order as indicated by numerals (1)-(2)-(3)-(4)-(5)-(6), which means the device functions as a dielectric resonator device consisting of a six-stage resonator.

In the example shown in FIG. 10, magnetic field coupling is effected between the dielectric columns 11*a* and 11*b* and between the dielectric columns 12*a* and 12*b* through the magnetic-field-coupling window 20*ab*, and magnetic field coupling is effected between the dielectric columns 11*b* and 11*c* and between the dielectric columns 12*b* and 12*c* through the magnetic-field-coupling window 20*bc*. Further, due to the electric-field-coupling grooves D provided in the crossing section of the dielectric columns 11*a* and 12*a*, electric field coupling is effected between these dielectric columns 11*a* and 12*a*, and, due to the electric-field-coupling groove D provided in the crossing section of the dielectric columns 10*c* and 12*c*, electric field coupling is effected between these dielectric columns 10*c* and 12*c*. Thus, coupling is effected in the order of (1)-(2)-(3)-(4)-(5)-(6)-(7), which means the device functions as a dielectric resonator device consisting of a seven-stage resonator.

Figure 11:
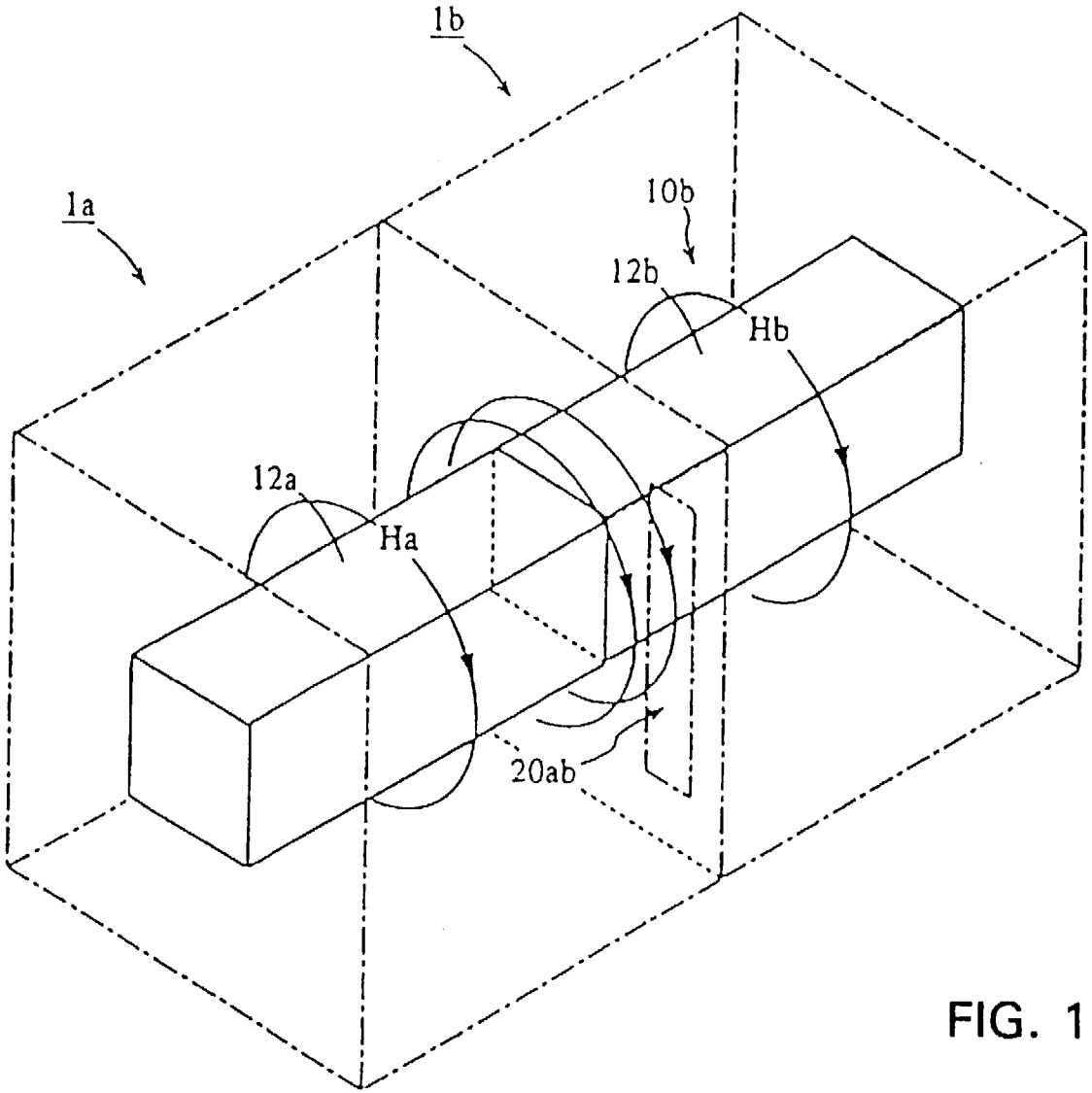
FIG. 11 is a diagram for illustrating the basic operation of this invention.
Figure 12:
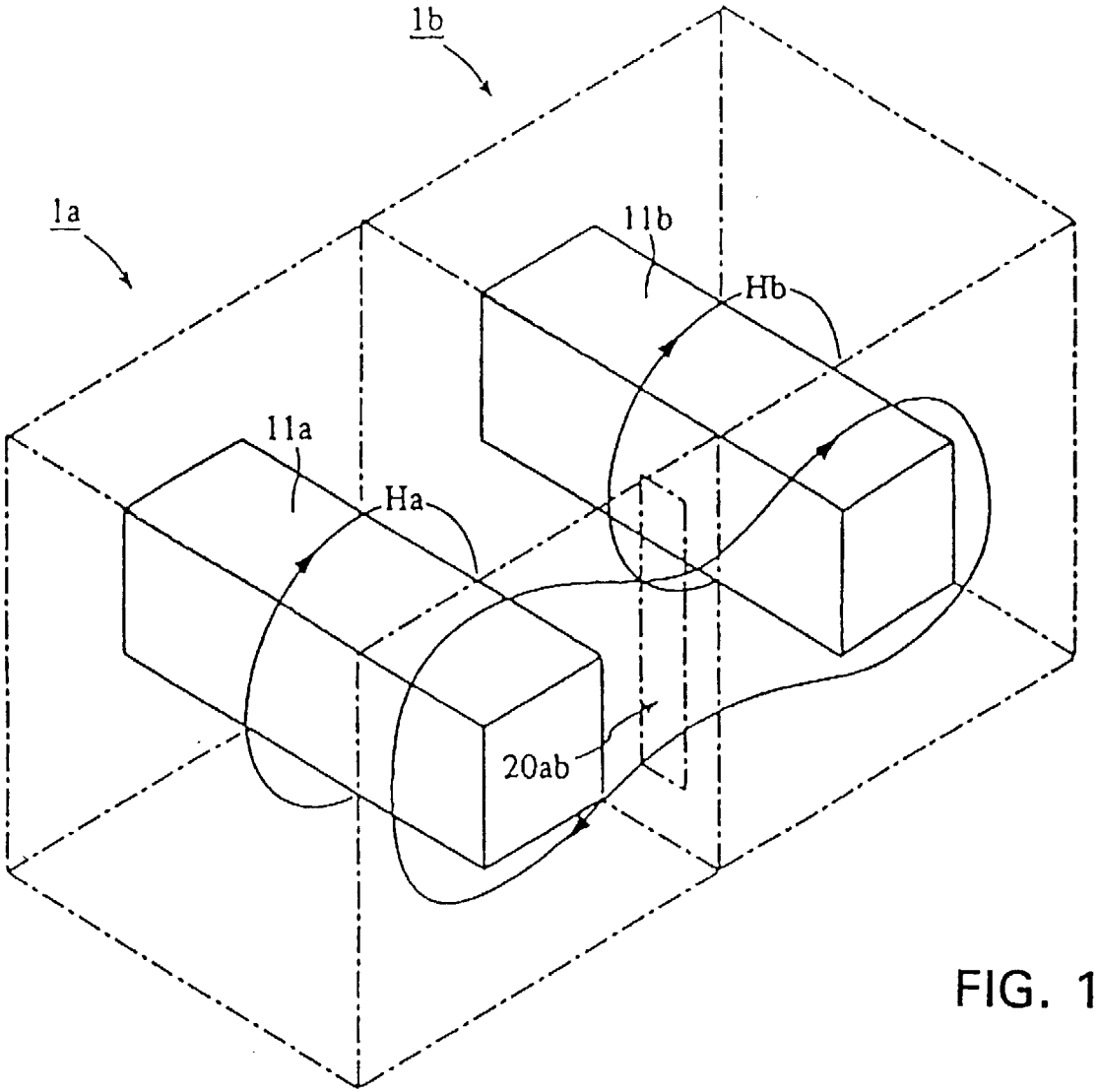
FIG. 12 is another diagram for illustrating the basic operation of this invention.
Figure 13:
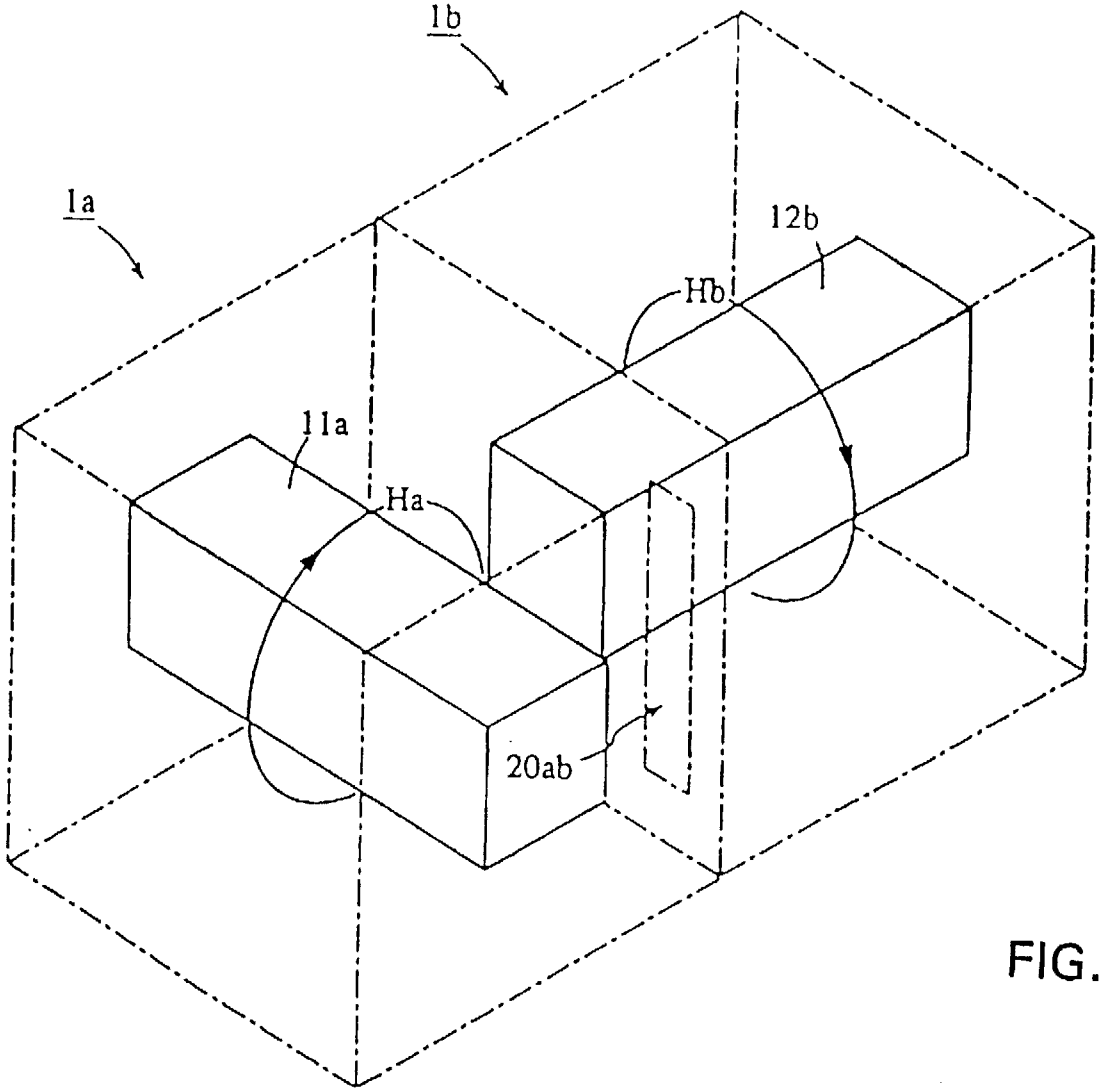
FIG. 13 is still another diagram for illustrating the basic operation of this invention.

In each of the devices shown in FIGS. 11 through 13, two TM single-mode dielectric resonators are arranged, with a magnetic-field-coupling window 20*ab* being provided in the interface between adjacent conductor portions of these resonators. When, as in the example of FIG. 11, the axes of the dielectric columns 12*a* and 12*b* are the same, the magnetic fields Ha and Hb generated around the dielectric columns 12*a* and 12*b*, respectively, are coupled together through the magnetic-field-coupling window 20*ab*. When, as shown in FIG. 12, the axes of the dielectric columns 11*a* and 11*b* are parallel to each other, the magnetic fields Ha and Hb that are generated around the dielectric columns 11*a* and 11*b*, respectively, are coupled together through the magnetic-field-coupling window 20*ab*. However, if, as shown in FIG. 13, the axes of the dielectric columns 11*a* and 12*b* are perpendicular to each other, the magnetic fields that are generated around these dielectric columns are not coupled together through the magnetic-field-coupling window 20*ab*.

FIGS. 14 and 15(A) through 15(C) show the construction of a dielectric resonator device according to the first embodiment of this invention, corresponding to the second aspect of the invention discussed above.

Figure 14:
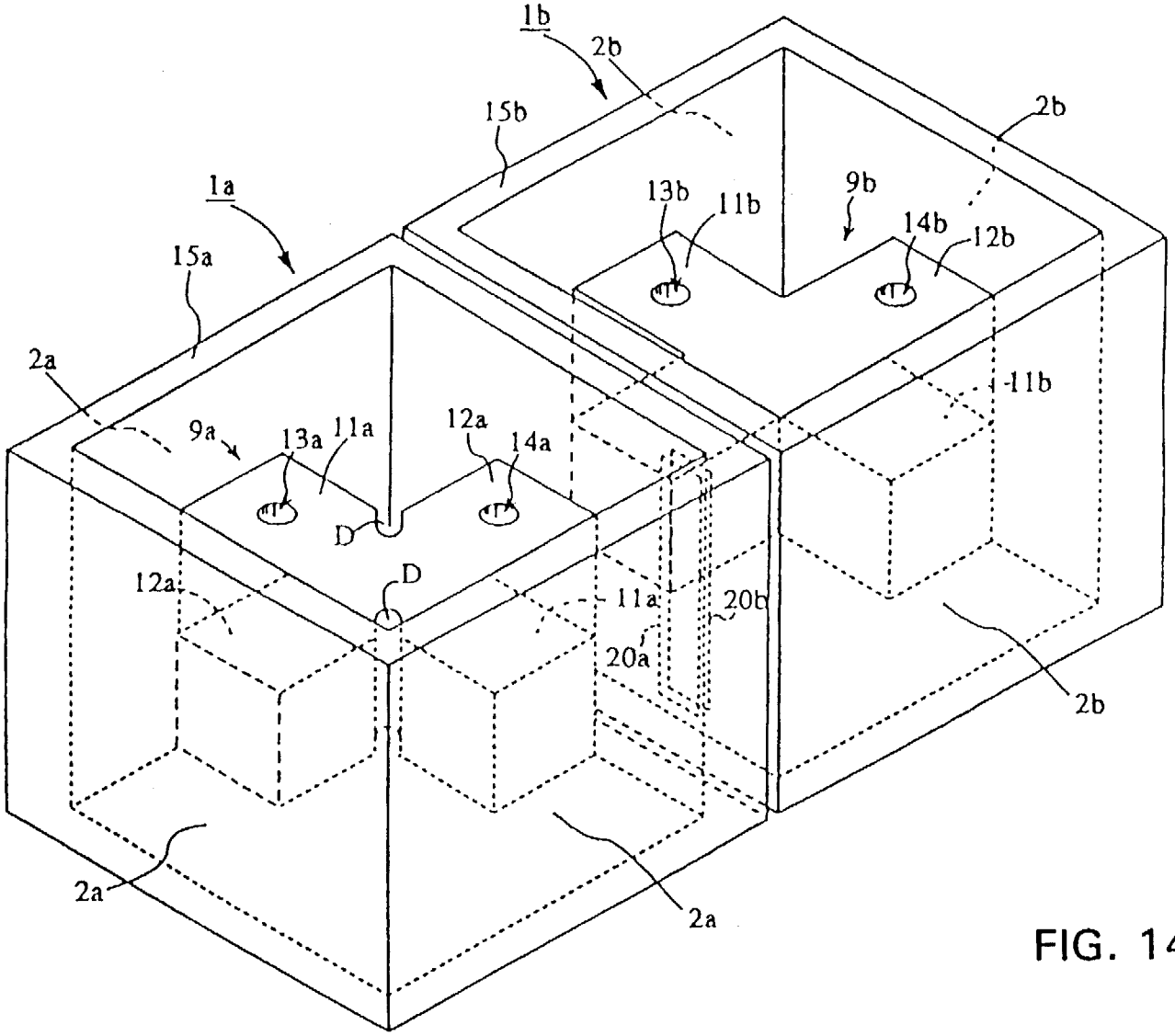
FIG. 14 is a perspective view showing the construction of a dielectric resonator device according to a first embodiment of this invention.

FIG. 14 is a perspective view of the principal section of a dielectric resonator device. In FIG. 14, numerals 9*a* and 9*b* indicate composite dielectric columns, each of which is composed of two dielectric columns crossing each other. These composite dielectric columns 9*a* and 9*b* are formed into integral units with prism-shaped cavities 15*a* and 15*b*, respectively. In the composite dielectric columns, frequency adjusting holes 13*a*, 14*a*, 13*b* and 14*b* are formed so as to extend in a direction perpendicular to the plane defined by these composite dielectric columns. The composite dielectric columns 9*a* and 9*b* and the cavities 15*a* and 15*b* form two TM dual-mode dielectric resonators 1*a* and 1*b*. Conductor layers 2*a* and 2*b* are formed on the outer periphery of the cavities 15*a* and 15*b*, respectively, by baking a conductive paste, such as silver paste, or by plating, etc.

Further, in a part of each of those surfaces of the cavities 15*a* and 15*b* which face each other, a magnetic-field-coupling window 20*a*, 20*b*, is formed so as to extend along the dimension of the magnetic field that is generated by the dielectric columns 12*a* and 12*b* and, at the same time, along the dimension of the magnetic field that is generated by the dielectric columns 11*a* and 11*b*. These magnetic-field-coupling windows 20*a* and 20*b* are formed by one of the following methods when forming the conductive layers 2*a* and 2*b* on the outer peripheral surfaces of the cavities 15*a* and 15*b*: when forming the conductive layers 2*a* and 2*b* by baking, the conductive paste is not applied to those sections where the magnetic-field-coupling windows 20*a* and 20*b* are to be formed; or when the conductive layers are formed by plating, those sections where the magnetic-field-coupling windows 20*a* and 20*b* are to be formed are masked; or, after forming the conductive layers 2*a* and 2*b* on the entire surfaces of the cavities 15*a* and 15*b*, part of the conductive layers is removed to thereby form the windows. Although in the example shown in FIG. 14, sections where no conductive layers are formed are used as the magnetic-field-coupling windows, it is also possible to form the magnetic-field-coupling windows by removing part of the walls of the cavities 15*a* and 15*b* along with the corresponding portions of the conductive layers to thereby form openings constituting the magnetic-field-coupling windows. As described below, metal panels are attached to the upper and lower openings of the cavities 15*a* and 15*b*, so that the composite dielectric columns are surrounded by these metal panels and the conductor layers provided on their outer peripheral surfaces.

Figure 15A:
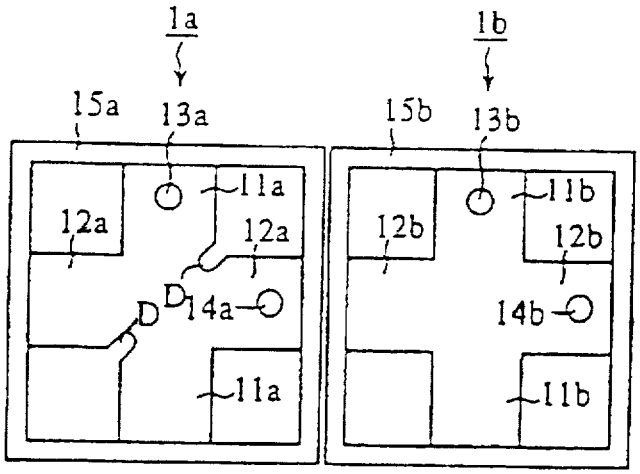
FIG. 15(A) is a plan view showing the construction of a dielectric resonator device according to the first embodiment.
Figure 15B:
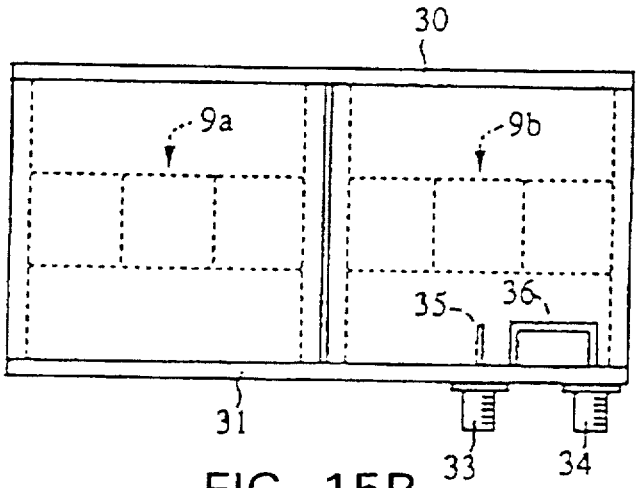
FIG. 15(B) is a front view showing the construction of a dielectric resonator device according to the first embodiment.
Figure 15C:
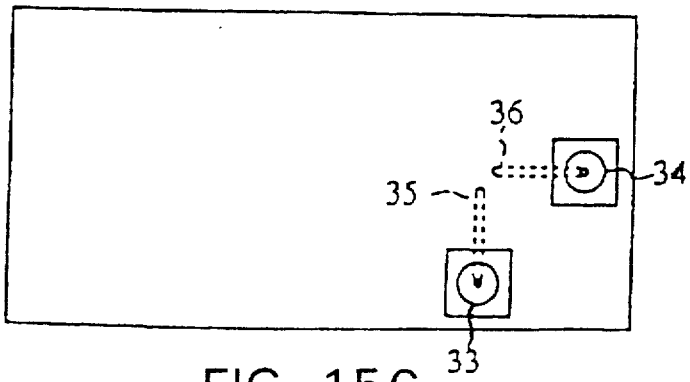
FIG. 15(C) is a bottom view showing the construction of a dielectric resonator device according to the first embodiment.
Figure 16:
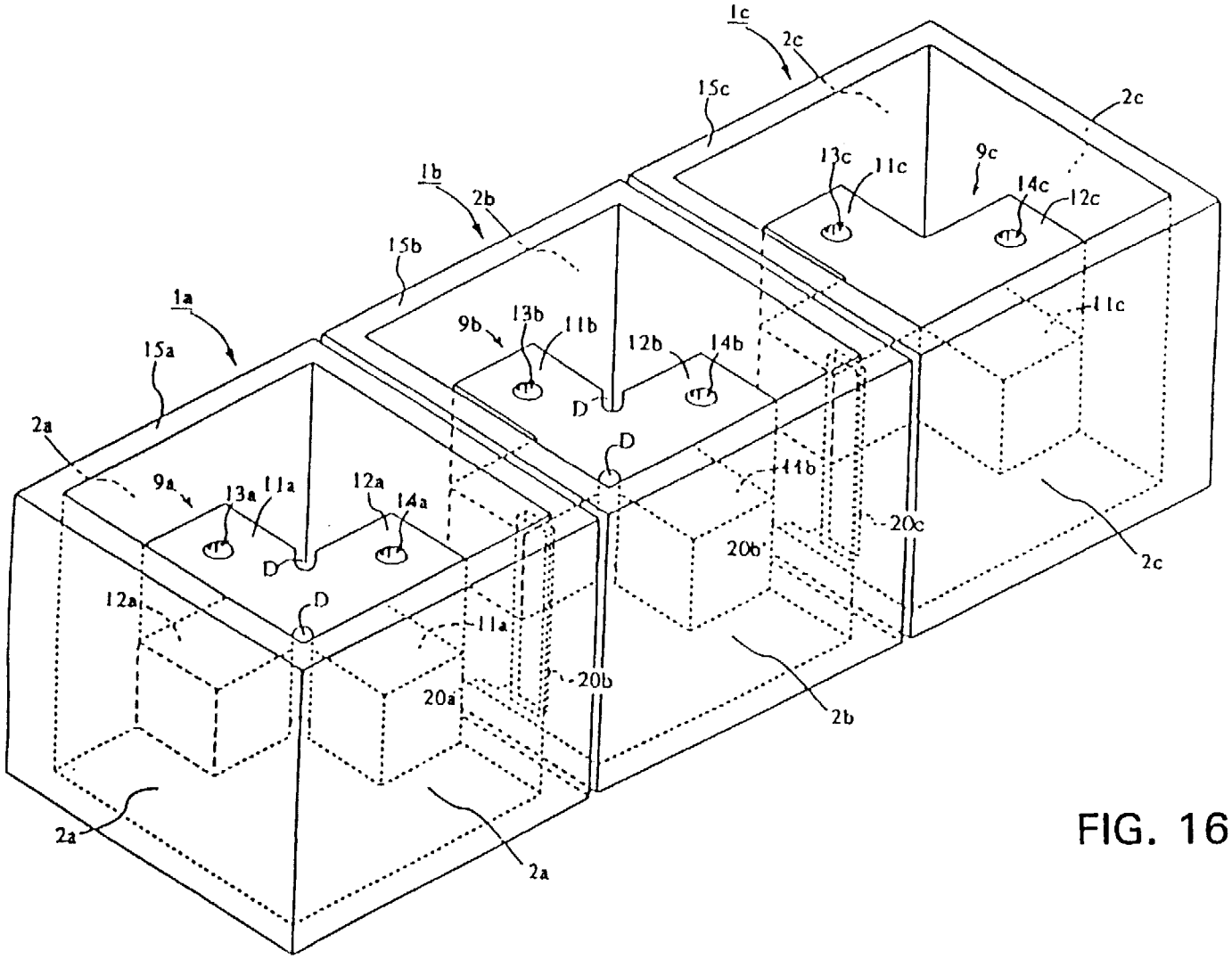
FIG. 16 is a perspective view showing the construction of a dielectric resonator device according to a second embodiment of this invention.

FIG. 15(A) is a plan view showing a dielectric resonator device according to the first embodiment; FIG. 15(B) is a front view thereof; and FIG. 15(C) is a bottom view thereof of these drawings, FIG. 15(A) shows the condition prior to the attachment of the metal panel to the upper surfaces of the cavities 15*a* and 15*b*. As shown in FIG. 15(B), metal panels 30 and 31 are attached to the upper and lower open surfaces of the cavities 15*a* and 15*b*. Though omitted in these drawings, in the spaces between the metal panel 30 and the composite dielectric columns 9*a* and 9*b*, there are provided blocks for holding frequency adjusting dielectric bars and coupling adjusting dielectric bars by threaded engagement. Due to the provision of these blocks, frequency adjusting dielectric bars are inserted into frequency adjusting holes, and coupling adjusting dielectric bars are inserted into grooves D. In the metal panel 30, there are provided holes into which an adjusting driver for turning the above-mentioned dielectric bars is inserted, whereby frequency adjustment and coupling adjustment can be effected from the metal panel 30 side.

Connectors 33 and 34 are attached to the metal panel 31, and coupling loops 35 and 36 are provided between the metal panel 31 and the central conductors of the connectors 33 and 34, respectively. The coupling loop 35 extends in a direction perpendicular to the plane of FIG. 15(B) and in magnetic field coupling with the dielectric column 11*b*. The loop surface of the coupling loop 36 extends in a direction in which the magnetic field generated by the dielectric column 12*b* passes, and is in magnetic field coupling with the dielectric column 12*b*. Due to the above construction, connection is generated according to the route: (1) the connector 33, (2) the dielectric column 11*b*, (3) the dielectric column 11*a*, (4) the dielectric column 12*a*, (5) the dielectric column 12*b*, (6) the connector 34, thus providing a dielectric resonator device consisting of a four-stage resonator which serves, for example, as a band-pass filter. The coupling coefficient between the first and second stages and the coupling coefficient between the third and fourth stages are adjusted by varying the positions, widths, lengths, inclinations, etc. of the magnetic-field-coupling windows 20*a* and 20*b* shown in FIG. 14. The coupling coefficient between the second and third stages is adjusted by varying the width or depth of the grooves D shown in FIG. 14, or by varying the amount by which the coupling adjusting members (dielectric bars) are inserted into these grooves.

Next, FIGS. 16 and 17(A) through 17(C) show the construction of a dielectric resonator device according to the second embodiment, which also corresponds to the second aspect of the invention discussed above. Unlike the first embodiment, the device of this embodiment comprises three TM dual-mode dielectric resonators 1*a*, 1*b* and 1*c* arranged in a row. Further, unlike the example shown in FIG. 3, in this embodiment, electric-field-coupling grooves D are also provided in the crossing section of the dielectric columns 11*b* and 12*b* constituting the composite dielectric column 9*b* of the middle dielectric resonator. Due to the construction shown in FIG. 16, magnetic field coupling is effected between the dielectric columns 12*a* and 12*b* and between the dielectric columns 11*a* and 11*b* through the magnetic-field-coupling windows 20*a* and 20*b*, respectively. Further, magnetic field coupling is effected between the dielectric columns 12*b* and 12*c* and between the dielectric columns 11*b* and 11*c* through the magnetic-field-coupling windows 20*b*' and 20*c*, respectively. Further, due to the presence of the electric-field-coupling grooves D, electric field coupling is effected between the dielectric columns 11*a* and 12*a* and, similarly, between the dielectric columns 11*b* and 12*b*.

Figure 17A:
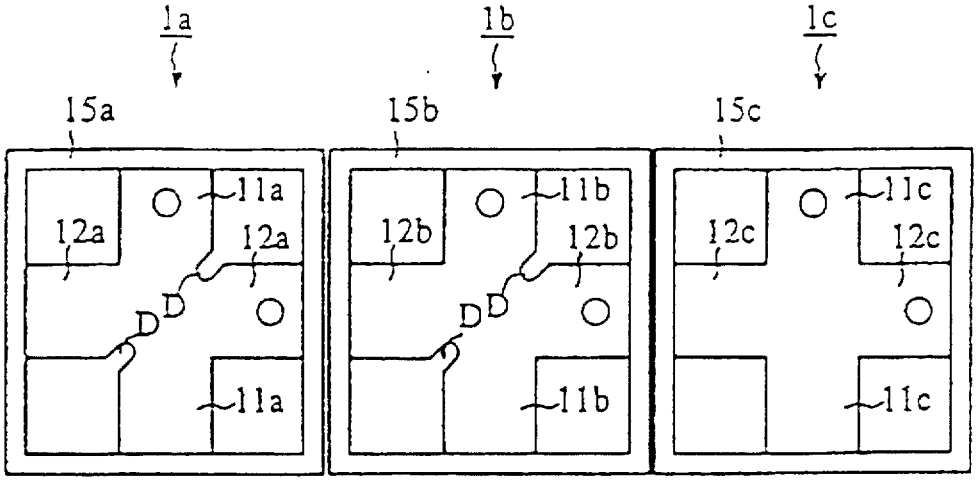
FIG. 17(A) is a plan view showing the construction of a dielectric resonator device according to the second embodiment.
Figure 17B:
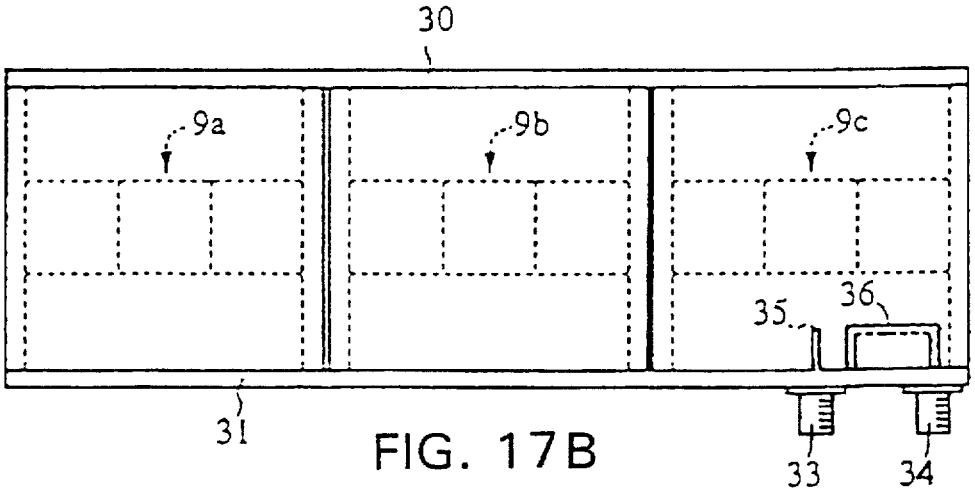
FIG. 17(B) is a front view showing the construction of a dielectric resonator device according to the second embodiment.
Figure 17C:
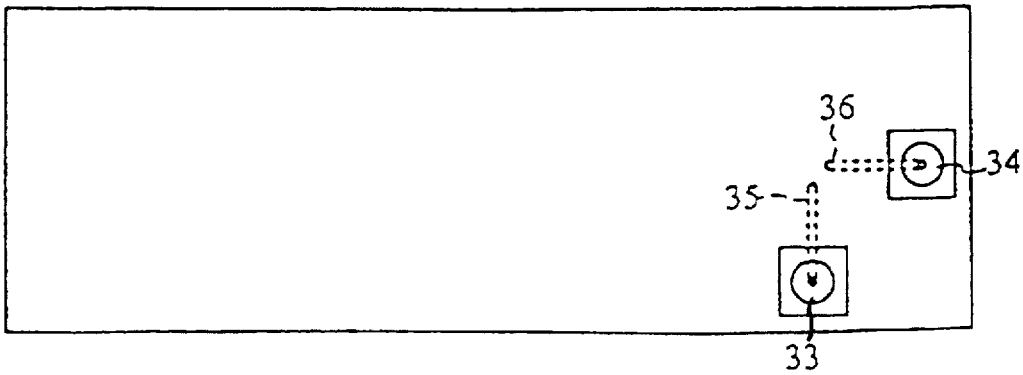
FIG. 17(C) is a bottom view showing the construction of a dielectric resonator device according to the second embodiment.

FIG. 17(A) is a plan view showing a dielectric resonator device according to the second embodiment; FIG. 17(B) is a front view thereof; and FIG. 17(C) is a bottom view thereof. Of these drawings, FIG. 17(A) shows the condition prior to the attachment of the metal panel to the upper surfaces of the cavities 15*a*, 15*b* and 15*c*. As shown in FIG. 17(B), metal panels 30 and 31 are attached to the upper and lower open surfaces of the cavities 15*a*, 15*b* and 15*c*. As in the case of the first embodiment, in the spaces between the metal panel 30 and the composite dielectric columns, there are provided frequency adjusting and coupling adjusting mechanisms. Connectors 33 and 34 are attached to the metal panel 31, and coupling loops 35 and 36 are provided between the metal panel 31 and the central conductors of the connectors 33 and 34. The coupling loops 35 and 36 are in magnetic field coupling with the dielectric columns 11*c* and 12*c*, respectively. Due to the above construction, main coupling is generated according to the route: (1) the connector 33, (2) the dielectric column 11*c*, (3) the dielectric column 11*b*, (4) the dielectric column 11*a*, (5) the dielectric column 12*a*, (6) dielectric column 12*b*, (7) dielectric column 12*c*, (8) the connector 34. And further, coupling is also generated according to the route between the dielectric column 11*b* and the dielectric column 12*b*, thus providing a dielectric resonator device consisting of a six-stage resonator, in which a "jump-over coupling" is generated between the second and fifth stages. Since a "jump-over" coupling can be thus realized without using any cable, it is possible to easily construct a band-pass filter having poles.

Further, while the example shown in FIGS. 16 and 17(A) through 17(C) has been described with reference to a case in which three TM dual-mode dielectric resonator devices are arranged to form a dielectric resonator device consisting of a six-stage generator, it is also possible to form a filter consisting of an n-stage resonator by arranging a plurality of TM dual-mode dielectric resonator devices in a similar fashion. Further, by coupling the composite dielectric columns of middle dielectric resonators, it is generally possible to generate, in a device consisting of an n-stage generator, a jump-over coupling between the i-th and (n−i+1)th stages.

Figure 18:
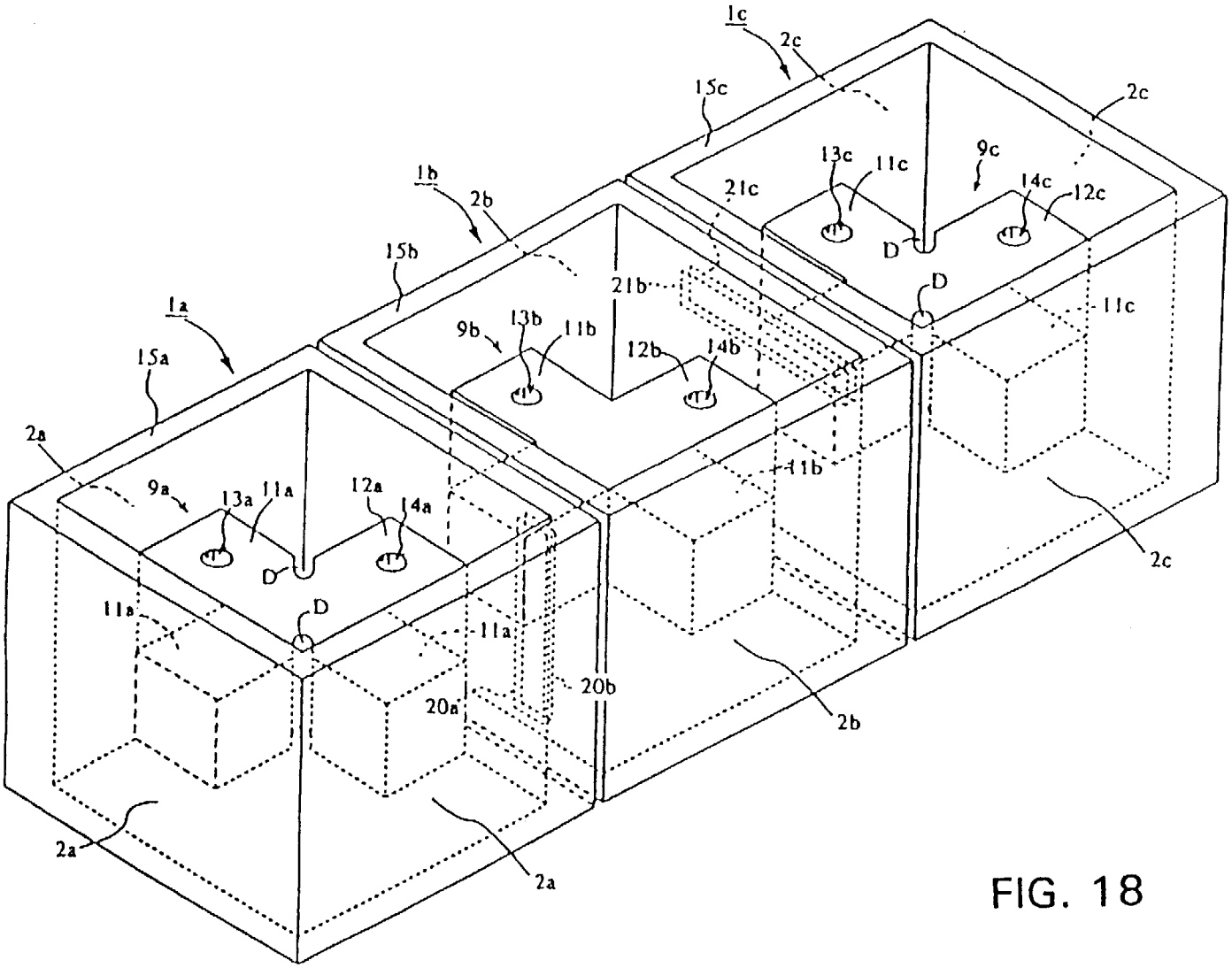
FIG. 18 is a perspective view showing the construction of a dielectric resonator device according to a third embodiment of this invention.

Next, FIGS. 18 and 19(A) through 19(C) show the construction of a dielectric resonator device according to the third embodiment, corresponding to the above-discussed third aspect of the invention. FIG. 18 is a perspective view of the principal part of a dielectric resonator device, which may be considered as a specific example of the construction of the dielectric resonator device shown in FIG. 6. Due to the construction shown in FIG. 18, magnetic field coupling is effected between the dielectric columns 12*a* and 12*b* and between the dielectric columns 11*a* and 11*b* through the magnetic-field-coupling windows 20*a* and 20*b*, respectively. Further, magnetic field coupling is effected between the dielectric columns 12*b* and 12*c* through the magnetic-field-coupling windows 21*b* and 21*c*, respectively. Further, due to the presence of the electric-field-coupling grooves D, electric field coupling is effected between the dielectric columns 11*a* and 12*a* and, similarly, between the dielectric columns 11*c* and 12*c*.

Figure 19A:
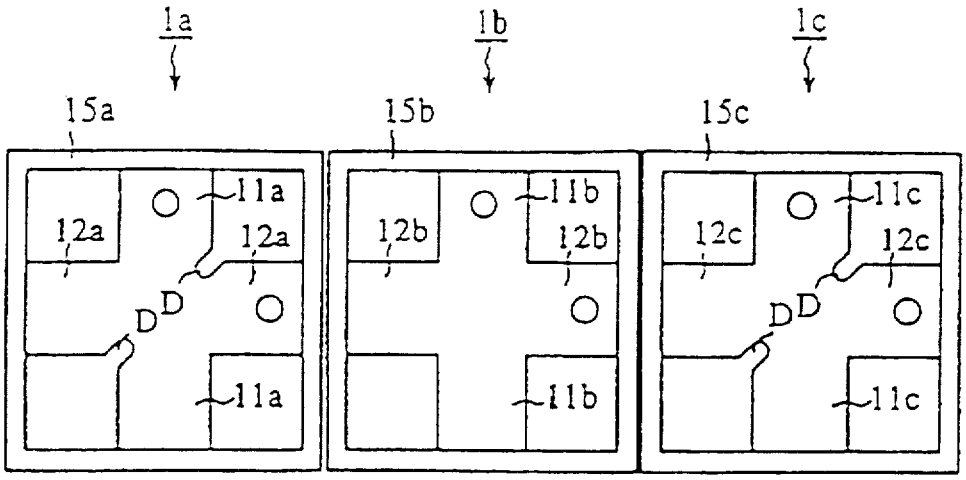
FIG. 19(A) is a plan view showing the construction of a dielectric resonator device according to the third embodiment.
Figure 19B:
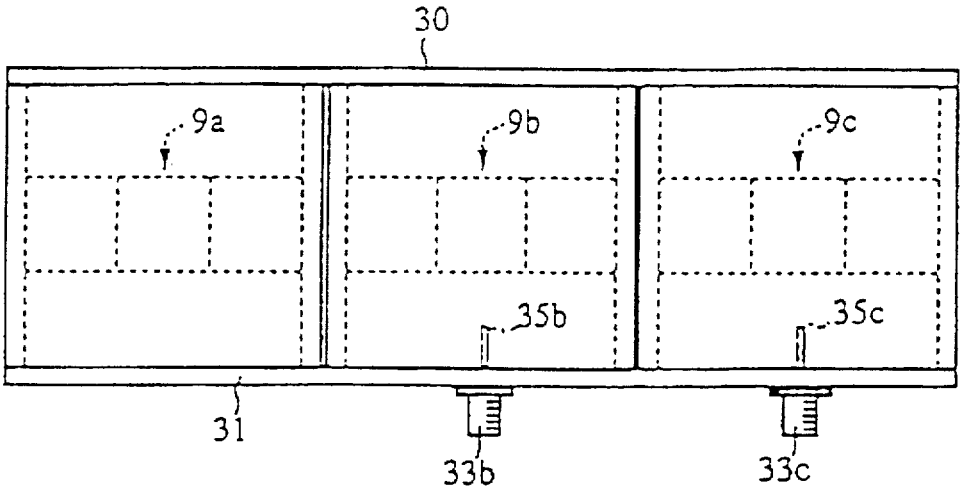
FIG. 19(B) is a front view showing the construction of a dielectric resonator device according to the third embodiment.
Figure 19C:
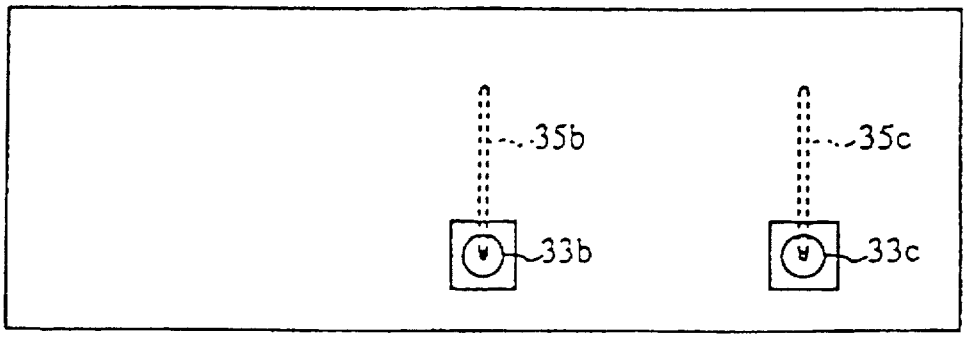
FIG. 19(C) is a bottom view showing the construction of a dielectric resonator device according to the third embodiment.

FIG. 19(A) is a plan view showing a dielectric resonator device according to the third embodiment; FIG. 19(B) is a front view thereof; and FIG. 19(C) is a bottom view thereof. Of these drawings, FIG. 19(A) shows the condition prior to the attachment of the metal panel to the upper surfaces of the cavities 15*a*, 15*b* and 15*c*. As shown in FIG. 19(B), metal panels 30 and 31 are attached to the upper and lower open surfaces of the cavities 15*a*, 15*b* and 15*c*. As in the first and second embodiments, in the spaces between the metal panel 30 and the composite dielectric columns, there are provided frequency adjusting and coupling adjusting mechanisms. Connectors 33 and 34 are attached to the metal panel 31, and coupling loops 35*b* and 35*c* are provided between the metal panel 31 and the central conductors of the connectors 33*b* and 33*c*. The coupling loops 35*b* and 35*c* are in magnetic field coupling with the dielectric columns 11*b* and 11*c*. Thus, coupling is generated according to the route: (1) the connector 33*b*, (2) the dielectric column 11*b*, (3) the dielectric column 11*a*, (4) the dielectric column 12*a*, (5) the dielectric column 12*b*, (6) the dielectric column 12*c*, (7) the dielectric column 11*c*, (8) the connector 33*c*, thus providing a dielectric resonator device consisting of a six-stage resonator. Since two coupling loops 35*b* and 35*c* are attached to separate dielectric resonators, an improvement can be achieved in terms of isolation between input and output stages as compared with the case in which two coupling loops are provided on the same dielectric resonator.

Figure 20:
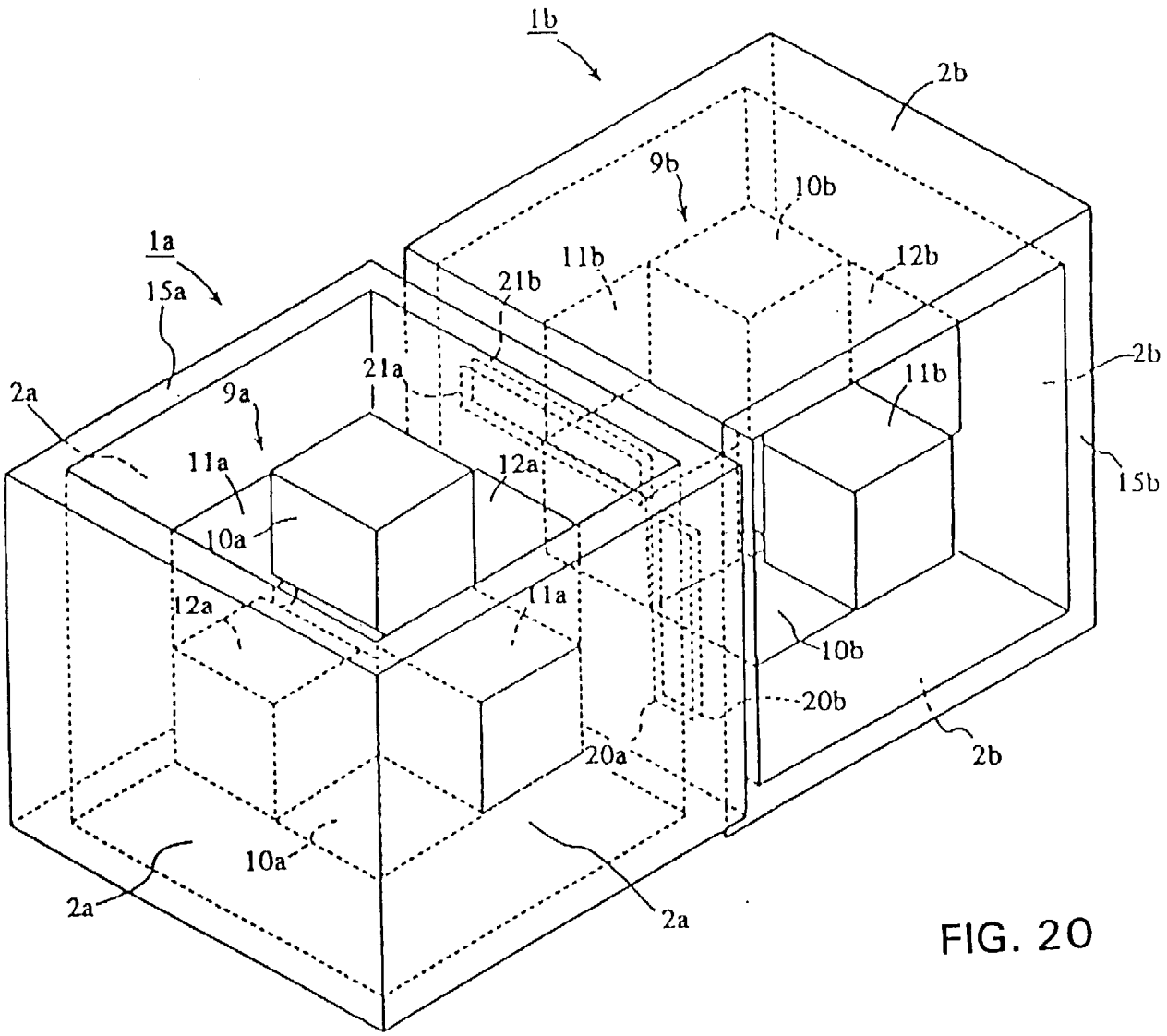
FIG. 20 is a perspective view showing the construction of a dielectric resonator device according to a fourth embodiment of this invention.

Next, FIGS. 20 and 21(A) through 21(C) show the construction of a dielectric resonator device according to the fourth embodiment, corresponding to the above-discussed fourth aspect of the invention. FIG. 20 is a perspective view of the principal part of a dielectric resonator device, which may be considered as a specific example of the construction of the dielectric resonator device shown in FIG. 9. In FIG. 20, numerals 1*a* and 1*b* indicate TM triple-mode dielectric resonators which comprise composite dielectric columns, each of which is composed of two dielectric columns crossing each other, and which are formed into integral units with prism-shaped cavities 15*a* and 15*b*, respectively. Conductor layers 2*a* and 2*b* are formed on the outer peripheral surfaces of the cavities 15*a* and 15*b*, respectively, by baking a conductive paste, such as silver paste, or by plating, etc.

Further, in a part of each of those surfaces of the cavities 15*a* and 15*b* which face each other, a magnetic-field-coupling window 20*a*, 20*b*, is formed so as to extend along the dimension of the magnetic field generated by the dielectric columns 12*a* and 12*b* and, at the same time, along the dimension of the magnetic field generated by the dielectric columns 11*a* and 11*b*; and a magnetic-field-coupling window 21*a*, 21*b*, is formed so as to extend along the dimension of the magnetic field generated by the dielectric columns 12*a* and 12*b* and, at the same time, along the dimension of the magnetic field generated by the dielectric columns 10*a* and 10*b*. Further, grooves are formed in the crossing section of the dielectric columns 10*a* and 12*a* and in the crossing section of the dielectric columns 11*b* and 12*b*. As described below, metal panels are attached to the open surfaces of the cavities 15*a* and 15*b*, so that the composite dielectric columns are surrounded by these metal panels and the conductor layers provided on the outer peripheral surfaces of the cavities.

Figure 21A:
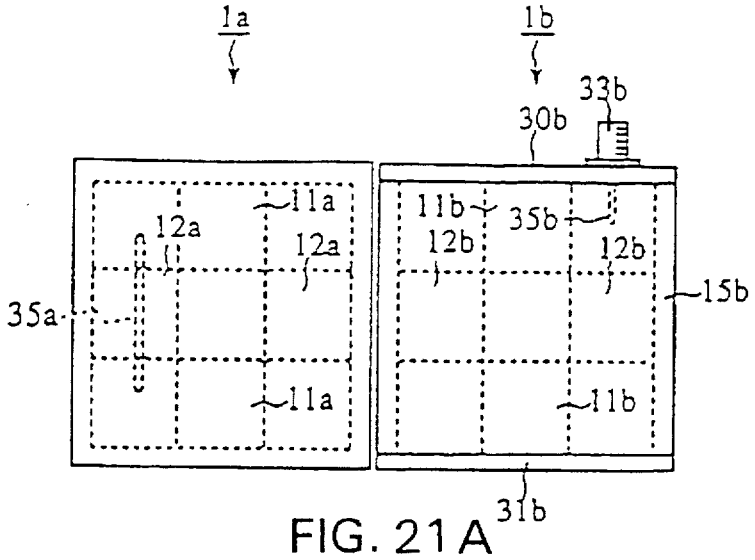
FIG. 21(A) is a plan view showing the construction of a dielectric resonator device according to the fourth embodiment.
Figure 21B:
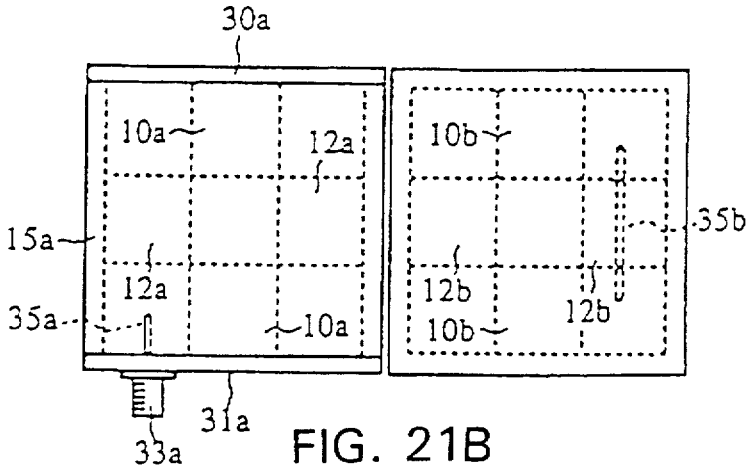
FIG. 21(B) is a front view showing the construction of a dielectric resonator device according to the fourth embodiment.
Figure 21C:
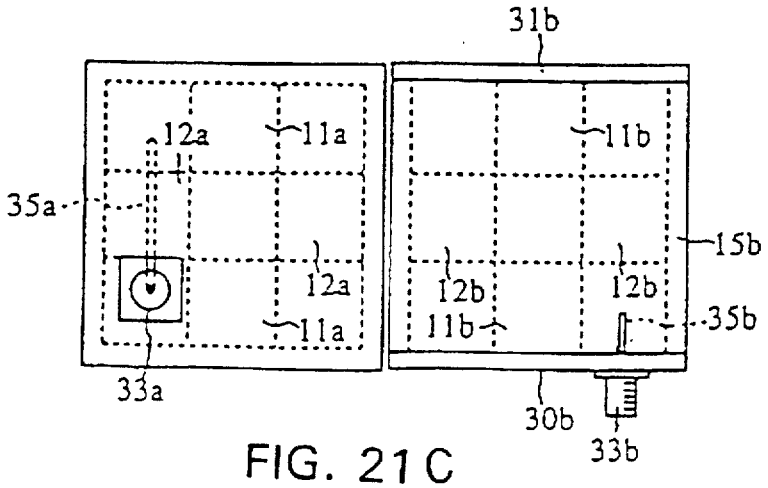
FIG. 21(C) is a bottom view showing the construction of a dielectric resonator device according to the fourth embodiment.

FIG. 21(A) is a plan view showing a dielectric resonator device according to the fourth embodiment; FIG. 21(B) is a front view thereof; and FIG. 21(C) is a bottom view thereof. As shown in FIG. 21(B), metal panels 30*a* and 31*a* are attached to the open surfaces of the cavity 15*a*, and a connector 33*a* is attached to the metal panel 31*a*, with a coupling loop 35*a*, which is in magnetic coupling with the dielectric column 11*a*, being provided between the metal panel 31*a*and the central conductor of the connector 33*a*. Further, metal panels 30*b* and 31*b* are attached to the open surfaces of the cavity 15*b*, and a connector 33*b* is attached to the metal panel 30*b*, with a coupling loop 35*b*, which is in magnetic coupling with the dielectric column 10*b*, being provided between the metal panel 30*b* and the central conductor of the connector 33*b*. Thus, coupling is generated according to the route: (1) the connector 33*b*, (2) the dielectric column 10*b*, (3) the dielectric column 10*a*, (4) the dielectric column 12*a*, (5) the dielectric column 12*b*, (6) the dielectric column 11*b*, (7) the dielectric column 11*a*, (8) the connector 33*a*, thus providing a dielectric resonator device consisting of a six-stage resonator.

When, as in the first through third embodiments, frequency adjusting and coupling adjusting mechanisms are provided between the metal panel and the composite dielectric columns, it is possible to effect frequency adjustment with respect to each dielectric column and coupling adjustment between the dielectric columns.

Although in the example shown in FIGS. 20 and 21(A) through 21(C), two TM triple-mode dielectric resonators are arranged such that the orientations of their cavity openings are different, in view of the attachment of connectors to the metal panels, it is also possible to adopt an arrangement in which, like the TM triple-mode dielectric resonator 1*a*, the TM triple-mode dielectric resonator 1*b* is also arranged with its open surfaces, to which the metal panels are to be attached, being vertically oriented as seen in FIG. 20, with a connector being attached to the metal panels, to thereby provide the connector with a coupling loop extending in the cavity opening direction.

Figure 22A:
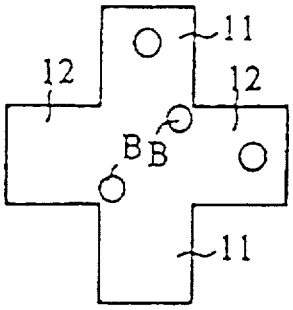
FIG. 22(A) is a diagram showing another example of the electric-field-coupling structure of this invention.
Figure 22B:
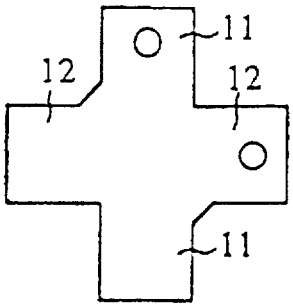
FIG. 22(B) is a diagram showing still another example of the electric-field-coupling structure of this invention.
Figure 23:
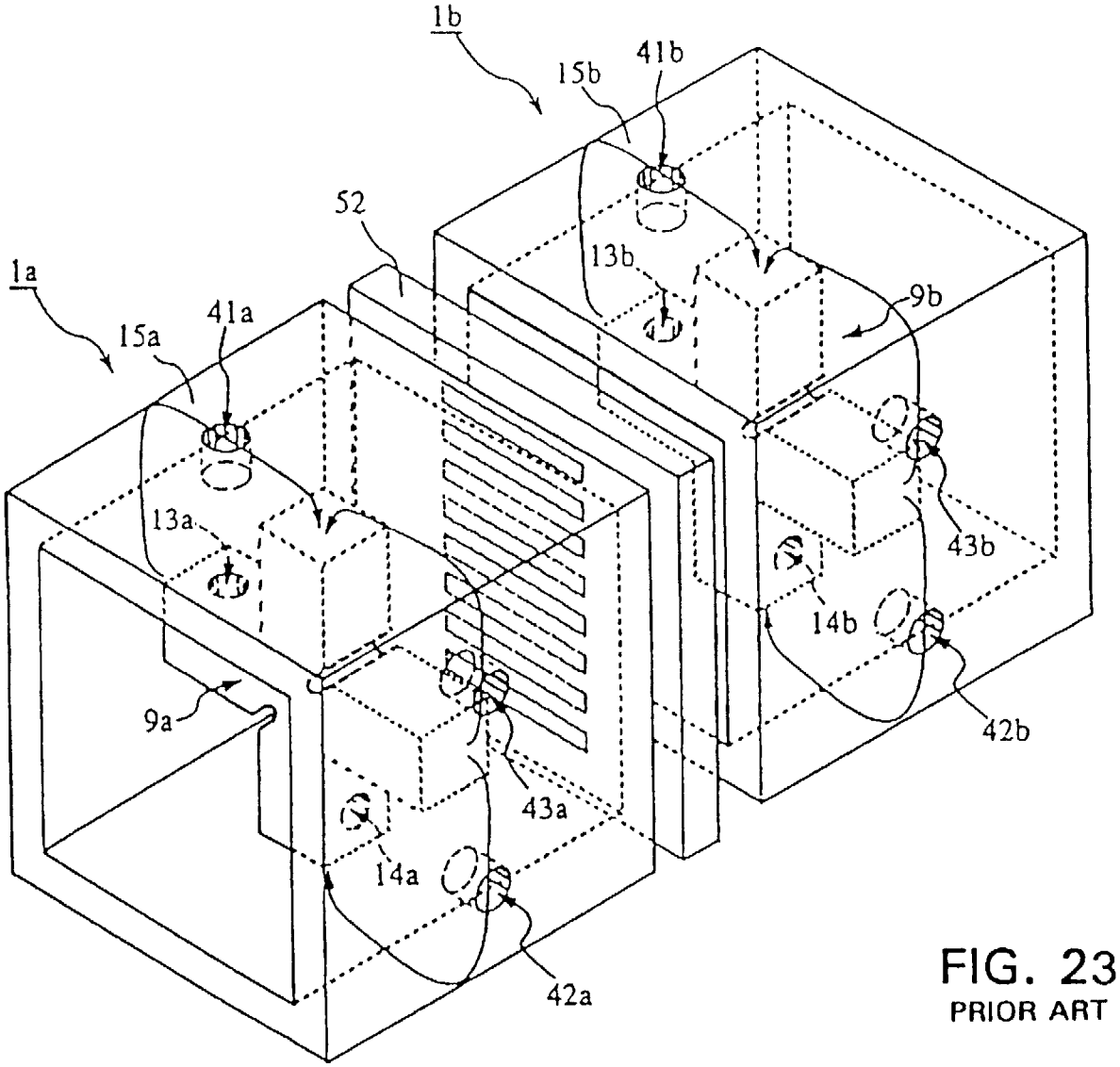
FIG. 23 PRIOR ART
FIG. 23 is a perspective view showing the construction of a conventional dielectric resonator device.

In the above-described embodiments, grooves D are formed in the crossing section of the two crossing dielectric columns of a composite dielectric column in order to effect electric field coupling between these dielectric columns. FIGS. 22(A) and 22(B) show other examples of a structure for effecting electric field coupling. In the example shown in FIG. 22(A), holes B are provided at the crossing section of dielectric columns 11 and 12. By inserting dielectric bars into these holes B and adjusting the amount they are inserted, it is possible to adjust the coupling coefficient between the dielectric columns 11 and 12. In the example shown in FIG. 22(B), the crossing section of the dielectric columns 11 and 12 is formed in an asymmetric configuration.

Further, while in the above-described embodiments a single rectangular section where no conductor layer is formed is provided as a magnetic-field-coupling window, it is also possible to provide such rectangular sections, where no conductor layer is formed, at positions that are in a transversely or vertically symmetrical relationship. Further, it is also possible to form such rectangular sections, where no conductor layer is formed, as slits, and arrange a plurality of them.

In accordance with this invention, selective coupling between composite dielectric columns is possible without having to employ a partition as in the prior art, whereby the number of parts can be reduced and a reduction in Q due to the partition can be avoided. Further, since there is no need to arrange the planes defined by two composite dielectric columns parallel to each other, it is possible to independently perform frequency adjustment and coupling adjustment by providing holes for the adjustment of characteristics perpendicularly to the planes made by the composite dielectric columns. Further, there is no need to provide holes for inserting characteristics adjusting members in the outer walls of the cavities, around which conductor layers are formed; and it is possible to successively effect magnetic field coupling between predetermined dielectric columns of adjacent dielectric resonators solely by spatial magnetic field coupling, without having to use a special coupling loop. Due to these advantages, it is possible to achieve an increase in the degree of freedom with respect to the manner of coupling between adjacent dielectric columns of an array of multiplex-mode dielectric resonators, thereby facilitating the design of a dielectric resonator device composed of a plurality of TM multiplex mode dielectric resonators.

In particular, in a dielectric resonator device according to the third aspect of the invention, it is possible to provide connectors for inputting and outputting signals on different TM multiplex mode dielectric resonators, whereby a sufficient degree of isolation is secured between the input and output stages.

Further, in a dielectric resonator device according to the fourth aspect, it is possible to effect magnetic field coupling between predetermined dielectric columns without providing any special coupling loop although a TM triple-mode dielectric resonator is used. Thus, it is possible to easily obtain a dielectric resonator device which is generally small-sized and which has a large number of stages.

Although the present invention has been described in relation to particular embodiments thereof, many other variations and modifications and other uses will become apparent to those skilled in the art.

Therefore, the present invention is not limited by the specific disclosure herein.

What is claimed is:

1. A dielectric resonator device comprising:

a pair of adjacent TM multiplex mode dielectric resonators each of which is composed of at least two dielectric columns crossing each other in a respective cavity surrounded by a corresponding conductor;

further comprising a magnetic-field-coupling window consisting essentially of a single substantially linear opening defined in said conductors which allows, between the dielectric columns of said two adjacent dielectric resonators, transmission of both a magnetic field of a first pair of dielectric columns which extend in a first direction and having axes which are substantially the same, and a magnetic field of a second pair of dielectric columns which extend in a second direction and having axes which are substantially parallel to each other.

2. A dielectric resonator device according to claim 1, further comprising an electric field coupling structure at a location of crossing of the dielectric columns extending in the first and second directions of one of said two adjacent dielectric resonators which effects electric field coupling between said dielectric columns.

3. A dielectric resonator device according to claim 1, wherein said opening extends in a third direction substantially perpendicular to both of said first and second directions.

4. A dielectric resonator device according to claim 1, wherein at least one of said two adjacent dielectric resonators is a TM triple-mode dielectric resonator; and further comprising, in said TM triple-mode dielectric resonator, an electric-field-coupling structure at a location of crossing of a dielectric column extending in the first direction and a dielectric column extending in a third direction which crosses the first and second directions, which effects electric field coupling between these dielectric columns.

5. A dielectric resonator device according to claim 1, wherein at least one of said two adjacent dielectric resonators further comprises a third dielectric column crossing said at least two dielectric columns thereof.

6. A dielectric resonator device according to claim 1, wherein both of said two adjacent dielectric resonators are TM triple-mode dielectric resonators, each of said resonators comprising a respective electric-field coupling structure which effects electric field coupling at a location of crossing of a corresponding pair of dielectric columns.

7. A dielectric resonator device according to claim 1, wherein both of said two adjacent dielectric resonators are TM triple-mode dielectric resonators, having a third pair of dielectric columns which extend in a third direction substantially perpendicular to said first and second directions.

8. A dielectric resonator device according to claim 7, further comprising a second magnetic-field coupling window consisting essentially of a single substantially linear opening defined in said conductors which allows transmission of a magnetic field between said third pair of dielectric columns.

9. A dielectric resonator device according to claim 8, wherein each of said TM triple-mode dielectric resonators has a respective electric-field-coupling structure which effects electric field coupling at a location of crossing of a corresponding pair of dielectric columns.

10. A dielectric resonator device comprising:

at least three adjacent TM multiplex mode dielectric resonators which are arranged in a row and each of which is composed of at least two dielectric columns crossing each other in a respective cavity surrounded by a corresponding conductor;

further comprising a first magnetic-field-coupling window consisting essentially of a respective single substantially linear opening defined in said conductors which allows, between the dielectric columns of the dielectric resonator at one end of the row and the dielectric column of the dielectric resonator adjacent thereto, transmission of both a magnetic field of a first pair of dielectric columns which extend in a first direction and having axes which are substantially the same, and a magnetic field of a second pair of dielectric columns which extend in a second direction and having axes which are substantially parallel to each other; and a second magnetic-field-coupling window consisting essentially of a second respective single substantially linear opening defined in said conductors which allows, between the dielectric columns of the dielectric resonator positioned at the other end of the row and the dielectric columns of the dielectric resonator adjacent thereto, transmission of a magnetic field of a third pair of dielectric columns which are respectively in said dielectric resonator at the other end of the row and the dielectric resonator adjacent thereto.

11. A dielectric resonator device according to claim 10, wherein at least one of said at least three adjacent dielectric resonators further comprises a third dielectric column crossing said at least two dielectric columns thereof.

12. A dielectric resonator device according to claim 10, wherein said third pair of dielectric columns extend in the second direction and have axes which are substantially parallel to each other.

13. A dielectric resonator device according to claim 10, wherein said third pair of dielectric columns extend in the first direction and have axes which are substantially the same.

14. A dielectric resonator device according to claim 13, wherein said second magnetic-field-coupling window further allows transmission of a magnetic field of a fourth pair of dielectric columns which are respectively in said dielectric resonator at the other end of the row and the dielectric resonator adjacent thereto and have axes which are substantially parallel to each other.

15. A dielectric resonator device according to claim 13, wherein said second magnetic-field-coupling window allows transmission of substantially only said magnetic field of said third pair of dielectric column.

16. A dielectric resonator device according to claim 15, further comprising a fourth pair of dielectric columns which are respectively in said dielectric resonator at the other end of the row and the dielectric resonator adjacent thereto and have axes which are substantially parallel to each other, wherein said second magnetic-field-coupling window does not substantially allow transmission of a magnetic field between said fourth pair.

17. A dielectric resonator device according to claim 16, further comprising an electric field coupling structure at a location of crossing of the dielectric columns of one of said dielectric resonator at said other end of the row and said dielectric resonator adjacent thereto.

18. A dielectric resonator device according to claim 17, wherein said electric field coupling structure is disposed in said dielectric resonator at said other end of the row.

19. A dielectric resonator device according to claim 15, wherein said second magnetic-field-coupling window extends in said second direction.

20. A dielectric resonator device according to claim 19, wherein said first magnetic-field-coupling window extends in a third direction substantially perpendicular to said first and second directions.

21. A dielectric resonator device according to claim 10, further comprising an electric field coupling structure at a location of crossing of the dielectric columns of one of said dielectric resonator at said one end of the row and said dielectric resonator adjacent thereto.

22. A dielectric resonator device according to claim 21, wherein said electric field coupling structure is disposed in said dielectric resonator at said one end of the row.

23. A dielectric resonator device according to claim 21, wherein said electric field coupling structure is disposed in said dielectric resonator adjacent to said dielectric resonator at said one end of the row.

24. A dielectric resonator device according to claim 21, further comprising an electric field coupling structure at a location of crossing of the dielectric columns of one of said dielectric resonator at said other end of the row and said dielectric resonator adjacent thereto.

25. A dielectric resonator device according to claim 24, wherein said electric field coupling structure is disposed in said dielectric resonator at said other end of the row.

26. A dielectric resonator device according to claim 24, wherein said electric field coupling structure is disposed in said dielectric resonator adjacent to said dielectric resonator at said other end of the row.

27. A dielectric resonator device according to claim 10, further comprising electric field coupling structures disposed respectively at corresponding locations of crossing of said dielectric columns of both said dielectric resonator at said one end of the row and said dielectric resonator adjacent thereto.

28. A dielectric resonator device according to claim 10, further comprising an electric field coupling structure at a location of crossing of the dielectric columns of one of said dielectric resonator at said other end of the row and said dielectric resonator adjacent thereto.

29. A dielectric resonator device according to claim 28, wherein said electric field coupling structure is disposed in said dielectric resonator at said other end of the row.

30. A dielectric resonator device according to claim 28, wherein said electric field coupling structure is disposed in said dielectric resonator adjacent to said dielectric resonator at said other end of the row.

31. A dielectric resonator device according to claim 10, wherein each said first and second magnetic-field-coupling window extends in a third direction substantially perpendicular to said first and second directions.

32. A dielectric resonator device according to claim 31, further comprising a fourth pair of dielectric columns which are respectively in said dielectric resonator at the other end of the row and the dielectric resonator adjacent thereto and have axes which are substantially perpendicular to each other, wherein said second magnetic-field-coupling window does not substantially allow transmission of a magnetic field between said fourth pair.

33. A dielectric resonator device according to claim 32, further comprising an electric field coupling structure at a location of crossing of the dielectric columns of said dielectric resonator at said other end of the row.

* * * * *